US006672962B1

(12) United States Patent
Ozaki et al.

(10) Patent No.: US 6,672,962 B1
(45) Date of Patent: Jan. 6, 2004

(54) GUN-SHAPED CONTROLLER AND GAME DEVICE

(75) Inventors: Naoji Ozaki, Tokyo (JP); Tomoyuki Sakurai, Tokyo (JP); Yutaka Okumura, Tokyo (JP); Junichiro Matsuura, Tokyo (JP); Makio Kida, Tokyo (JP); Masayuki Sumi, Tokyo (JP); Akihito Hiroyoshi, Tokyo (JP); Yutaka Yokoyama, Tokyo (JP)

(73) Assignee: Kabushiki Kaisha Sega Enterprises, Tokyo (JP)

( * ) Notice: Subject to any disclaimer, the term of this patent is extended or adjusted under 35 U.S.C. 154(b) by 0 days.

(21) Appl. No.: 09/462,791

(22) PCT Filed: May 13, 1999

(86) PCT No.: PCT/JP99/02490

§ 371 (c)(1),
(2), (4) Date: Jun. 19, 2000

(87) PCT Pub. No.: WO99/58214

PCT Pub. Date: Nov. 18, 1999

(30) Foreign Application Priority Data

| | | |
|---|---|---|
| May 13, 1998 | (JP) | 10-130862 |
| Oct. 8, 1998 | (JP) | 10-286513 |
| Mar. 26, 1999 | (JP) | 11-085007 |

(51) Int. Cl.[7] ..... A63F 18/00
(52) U.S. Cl. ..... 463/37
(58) Field of Search ..... 463/36–39; 273/148 B; 345/156, 157, 161, 181, 184

(56) References Cited

U.S. PATENT DOCUMENTS

| | | | |
|---|---|---|---|
| 5,310,192 | A | 5/1994 | Miyake |
| 5,569,085 | A | 10/1996 | Igarashi et al. |
| 5,577,962 | A | 11/1996 | Kounoe et al. |
| 5,853,324 | A | 12/1998 | Kami et al. |

FOREIGN PATENT DOCUMENTS

| | | |
|---|---|---|
| EP | 0 679 986 A1 | 11/1995 |
| EP | 0 679 986 A | 11/1995 |
| JP | 52-080700 | 7/1977 |
| JP | 04-040977 | 2/1992 |
| JP | 04-174694 | 6/1992 |
| JP | 05-177058 | 7/1993 |
| JP | 05-192449 | 8/1993 |
| JP | 06-180748 | 6/1994 |
| JP | 06-190146 | 7/1994 |
| JP | 06-198075 | 7/1994 |
| JP | 07-024147 | 1/1995 |
| JP | 07-073343 | 3/1995 |
| JP | 07-136343 | 5/1995 |
| JP | 07-178242 | 7/1995 |
| JP | 07-204356 | 8/1995 |
| JP | 07-313731 | 12/1995 |

(List continued on next page.)

OTHER PUBLICATIONS

Computer Translation of JP 8–206359 A Submitted by Applicant in an IDS, Aug. 1996.*

(List continued on next page.)

*Primary Examiner*—Michael O'Neill
(74) *Attorney, Agent, or Firm*—Finnegan, Henderson, Farabow, Garrett & Dunner, L.L.P.

(57) ABSTRACT

The gun-shaped controller comprises a controller 1 in the shape of a gun and a trigger lever 7, and a cross-shaped directional key 9 to be operated with a player's finger is arranged in the upper part of a grip 4. By comprising the cross-shaped directional key 9, it is possible to move the character on the screen or the character's visual field with this cross-shaped directional key 9 in addition to the conventional action of shooting targets on the screen. Thus, the gun-shaped controller is compatible with roll-playing games and adventure games.

44 Claims, 34 Drawing Sheets

FOREIGN PATENT DOCUMENTS

| | | |
|---|---|---|
| JP | 08-019664 | 1/1996 |
| JP | 08-089661 | 4/1996 |
| JP | 08-191953 | 7/1996 |
| JP | 08-206359 | 8/1996 |
| JP | 08-257243 | 10/1996 |
| JP | 09-225144 | 2/1997 |
| JP | 09-131466 | 5/1997 |
| JP | 09-161095 | 6/1997 |
| JP | 2686675 | 8/1997 |
| JP | WO97/32641 | 9/1997 |
| JP | 10-033831 | 2/1998 |

OTHER PUBLICATIONS

Computer Translation of JP 8–191953 Submitted by Applicant in an IDS, Jul. 1996.*

Computer Translation of JP 6–198075 Submitted by Applicant in an IDS, Jul. 1994.*

A Douglas: "Time Crisis Review" XP002200685, ,URL: psx.ign.com/reviews/2126.html, pp. 1–4 (Jun. 19, 2001; and per Search Nov. 11, 1997.

Douglas, A., "Time Crisis: The Best PlayStation Light Gun Game has Finally Landed–and it Comes Packaged with the Best Light Gun. Oh Happy Day!" wysiwyg://20/http://psx.ign.com/articles/152/152126(Document No. XP–002200685).

"Dreamcast," JUGEMU, vol. 7, pp. 26–27 (1998).

* cited by examiner

GUN-SHAPED CONTROLLER AND GAME DEVICE

BACKGROUND OF THE INVENTION

1. Field of the Invention

The present invention generally relates to a gun-shaped controller to be connected to electronic devices such as a video game machine, and particularly to a gun-shaped controller suitable for being used in gun games whereby characters displayed on a monitor screen are shot as targets.

The present invention further relates to a game device comprising a gun-shaped controller imitating, for example, bazookas, rocket launchers, grenade launchers, and torpedoes, a game machine for processing game programs in accordance with instruction signals from the gun-shaped controller, and a display means for displaying pictures from this game machine.

2. Description of the Related Art

Pursuant to the diversification of video game software in recent years, various controllers-from conventional controllers having instruction buttons and cross-shaped keys to joystick-type controllers and gun-shaped controllers-are out on the market corresponding to the game software to be used. In Patent Publication No. 2686675, for example, disclosed is a gun-shaped controller, which is a model gun, for a gun game.

This gun-shaped controller for a gun game comprises a trigger lever similar to an actual gun to which a player's finger is placed, and a light sensor for detecting the flashing light from a CRT screen is provided to the tip of this gun-shaped controller. When the player pulls the trigger lever of the controller, the CRT screen instantaneously becomes a white screen in order to detect the impact position and emits flashing light. This white screen is realized by raster scanning. When the raster light appears at the coordinate position on the CRT display indicated by the light sensor, the light sensor detects this light and the controller detects the impact position by reading the X-Y coordinates of the raster scanning at such time. The game machine thereby judges whether the impact position coincides with the shooting target, and the game is progressed in accordance with a hit or a miss.

As an operation means on the player's side in this type of gun-shaped controller for gun games, the present situation is that other than the trigger lever mentioned above, provided is merely a button or the like for starting the game. Therefore, the mainstream of gun games using this controller is an orthodox shooting game whereby a player directly shoots at targets on the monitor screen.

As a variation of this type of game, there is a shooting game where a character, such as a police officer, appears on the monitor screen in place of the player and successively shoots the enemies appearing on the screen. Nevertheless, this character is either fixed to a prescribed position within the screen or, even if it were able to move, the movement is predetermined by the program and the like. Thus, this type of game is also no better than a simple shooting game.

Accordingly, game devices employing these gun-shaped controllers are also no better than a simple shooting game, and therefore lack amusement.

SUMMARY OF THE INVENTION

An object of the present invention is to provide a gun-shaped controller capable of increasing the variation of the game software to be used and performing highly amusing games.

Another object of the present invention is to provide a game device enabling a game development with enhanced amusement by employing the gun-shaped controller.

Still another object of the present invention is to provide a game device enabling a virtual sensation in accordance with the situation during such game development.

The above objects are achieved by a gun-shaped controller for transmitting instruction signals pertaining to the game development with respect to the game image displayed on the screen of a display means, characterized in that the gun-shaped controller comprises integrally an operation key for transmitting, as a part of the aforementioned instruction signals, signals instructing a plurality of directions on the screen.

In the gun-shaped controller, preferably, the operation key is manually operable by the operator, and the instruction signals move the objects displayed on the screen in a plurality of directions. As one example, the operation key is a cross-shaped directional key capable of moving the displayed object upward, downward, leftward, and rightward as the plurality of directions.

In the gun-shaped controller, for example, the displayed object is a character or cursor displayed on the screen.

In the above structure, the gun-shaped controller comprises a gun barrel, grip to be held by the player, and trigger lever to be operated by the player, and the operation key may be arranged on the upper part of the grip.

In the above structure, the gun-shaped controller comprises a gun barrel, grip to be held by the player, and trigger lever to be operated by the player, and the operation key may be arranged in the vicinity of the tip of the gun barrel.

The above objects are achieved by a gun-shaped controller for transmitting predetermined instruction signals comprising a gun barrel, grip to be held by the player, and trigger lever to be operated by the player, characterized in that the gun-shaped controller has a contact sensor for detecting the contact of the operator and is provided with a virtual bullet-loading portion for loading bullets virtually based on the contact state of the operator and the contact sensor.

In the gun-shaped controller, the virtual bullet-loading portion is provided to the bottom of the grip and may further comprise a sensor holder for movably mounting the contact sensor on the bottom of the grip.

The above objects are achieved by a gun-shaped controller for transmitting predetermined instruction signals comprising a gun barrel, grip to be held by the operator, and trigger lever to be operated by the operator, characterized in that the gun-shaped controller has a reload lever provided to the side of the gun barrel and arranged so as to be slidable on the side of the gun barrel, and a virtual bullet-loading portion for virtually loading bullets with the operation of the reload lever.

The above objects are achieved by a gun-shaped controller for transmitting predetermined instruction signals comprising a gun barrel, grip to be held by the operator, and trigger lever to be operated by the operator, characterized in that the gun-shaped controller is provided with a mounting portion for mounting a memory device. In the gun-shaped controller, the memory device may be provided with a display screen for displaying information.

In the gun-shaped controller, the mounting portion may be provided to the tail protruding to the rear from the grip.

In the gun-shaped controller, a cable may be provided to the rear end of the grip.

In the gun-shaped controller, a cable may be provided to the rear end of the tail.

The above objects are achieved by a gun-shaped controller for transmitting predetermined instruction signals comprising a gun barrel, grip to be held by the operator, and trigger lever to be operated by the operator, characterized in that the gun-shaped controller is provided with a display screen for displaying information.

The above objects are achieved by a gun-shaped controller for transmitting predetermined instruction signals comprising a gun barrel, grip to be held by the operator, and trigger lever to be operated by the operator, characterized in that the lower face of the gun barrel is formed diagonally with respect to the lengthwise axis of the gun barrel from the lower face of the vicinity of the tip of the gun barrel to the portion to be connected with the trigger, and a directional key for instructing directions is provided to the upper part of the grip.

In the gun-shaped controller, an operation button may be provided to the upper part of the directional key.

In the gun-shaped controller, the directional key may be arranged on a face formed continuously to the rear face of the grip and inclined toward the tip of the gun barrel rather than the rear face.

In the gun-shaped controller, it is preferable that the directional key is positioned higher than, at the least, the tip of the trigger lever when the lengthwise axis of the gun barrel is to be the horizontal standard.

In the gun-shaped controller, it is preferable that the directional key is positioned approximately in the center of the widthwise direction of the gun when viewed from the rear of the gun.

In the gun-shaped controller, it is preferable that the mounting portion for mounting a peripheral is formed in the lengthwise axis direction of the gun barrel at the rear of the gun barrel and positioned at the upper part of the directional key.

In the gun-shaped controller, it is preferable that the peripheral is a memory device comprising a display screen for displaying information.

In the gun-shaped controller, it is preferable that the trigger lever is provided to a position easily operable with an index finger of the operator's hand holding the grip, and the directional key is provided to a position easily operable with the thumb of the operator's hand holding the grip. Thereby, the operator may operate the gun-shaped controller single-handedly.

The above objects are achieved by a gun-shaped controller comprising a gun barrel, wherein the operator is able to conduct the operation of virtually firing a cannonball toward a game image displayed on the screen of the display means, characterized in that the gun-shaped controller further comprises a recoil mechanism for providing recoil to the gun barrel when the cannonball is fired.

The above objects are achieved by a game device for forming game images in a style wherein an enemy character and main character shown within the screen displayed on the display means battle each other, characterized in that the game device comprises a gun-shaped controller capable of transmitting, at the least, instruction signals for moving the main character on the screen and instruction signals for attacking a target on the game screen, and a game machine for processing a predetermined game program, moving the main character pursuant to the instruction signals from the gun-shaped controller, and progressing and developing the game.

In the game device, the game machine may comprise an image processing means for forming images of the main character successively moving along a predetermined course.

In the game device, the game machine may comprise an image processing means for forming game images from an objective viewpoint to view the main character when provided with instruction signals from the gun-shaped controller for moving the main character, and an image from the main character's viewpoint when battling an enemy character.

In the game device, the gun-shaped controller may comprise a gun barrel, grip to be held by the operator, trigger lever to be operated by the operator, light detecting means for obtaining light detection signals for detecting the position on the screen of the display means provided to the front portion of the gun barrel, directional key provided to the upper part of the gun barrel for instructing the main character to move left or right, signal processing means for transmitting predetermined instruction signals according to the operation and transmitting light detection signals from the light detecting means, supporting mechanism for rotatably supporting the gun barrel on a pedestal, and recoil mechanism for providing recoil to the gun barrel when the cannonball is fired.

In the game device, the recoil mechanism may comprise a movable mechanism for supporting the gun barrel and supporting mechanism reciprocally and biasing the gun barrel in one direction with an elastic member, rotation/reciprocation converter mechanism for supplying reciprocation to the movable mechanism, and driving source for rotatably driving the rotation/reciprocation converter mechanism.

In the game device, a plurality of operation buttons enabling a push operation of predetermined strokes at the rear of the gun barrel are arranged on the upper part of the pedestal supporting the gun barrel of the gun-shaped controller. The game machine may comprise a game processing means for determining the attacking power, destruction power and impact distance of the cannonball in accordance with the operation pattern of the plurality of operation buttons on the virtual bullet-loading portion, and progressing the game in accordance with such determination.

In the game device, the virtual bullet-loading portion comprises an operation button, to which a push operation of predetermined strokes is enabled, for transmitting operation signals of such push operation, locking mechanism for locking the operation button when the operation button is pushed a prescribed number of strokes, and unlocking mechanism for unlocking the operation button when a cannonball is fired by the operation of the trigger lever.

In the game device, the game machine successively forms three-dimensional explosion images of the course of the cannonball impacting, exploding, and disappearing in accordance with the lapse of time, and may comprise an image processing means for applying, to the three-dimensional explosion images showing the course of disappearance, two-dimensional explosion images similarly showing the course of disappearance as a semi-transparent texture.

In the game device, the game machine may comprise an image processing means which, when performing modifying processing to characters as a result of a cannonball explosion and the like, determines the polygon position of the character before modification and the polygon position of the character after modification, and performs interpolation processing of modifying the polygons therebetween based on polygon position information of both characters.

In the game device, the image processing means calculates coordinate x of the vertex of the polygon to be interpolated from the beginning of modification to the completion thereof with the formula of:

$$x=a+(b-a)\times(g/t)$$

wherein a is the coordinate of the vertex of the polygon before modification, b is the coordinate of the vertex of the polygon after modification, t is the total number of steps until completion of modification, and g is the current number of steps.

The aforementioned game device comprises a housing containing the game machine and display means, and gun-shaped controller rotatably secured to a pedestal arranged in front of the display means of the housing via a supporting mechanism.

In the game device, the gun-shaped controller may be structured of a shape imitating a bazooka.

In the game device, on the upper part of the housing, indicators having the same color as the plurality of operation buttons provided to the pedestal supporting the gun barrel of the gun-shaped controller are provided in the same arrangement as the plurality of buttons, characterized in that the indicator corresponding to the operation button may light up when the operation button is pushed a predetermined number of strokes and locked by the locking mechanism, and the indicator corresponding to the operation button may turn off when the operation button is unlocked by the cannonball being fired with the operation of the trigger lever.

In the game device, the game machine may comprise an image processing means for forming image signals capable of respectively displaying a cursor, which displays the moving direction of the main character, on the left and right sides of the screen of the display means, changing the color of the cursor in accordance with the instruction signals and game development, and forming image signals capable of displaying the moving direction of the main character or outline of the situation of the main character during the game development using the combination of the colors thereof.

In the game device, the gun-shaped controller may comprise integrally an operation key for transmitting, as a part of the instruction signal, signals to move, at the least, the main character in a plurality of directions on the screen. Thereby, the operation key of the gun-shaped controller is manually operable by an operator, and the instruction signal may be a signal for moving, at the least, the main character in a plurality of directions on the screen. For example, the operation key of the gun-shaped controller may be a cross-shaped directional key capable of moving, at the least, the main character upward, downward, leftward, and rightward as the plurality of directions.

DESCRIPTION OF THE PREFERRED EMBODIMENTS

Figure 1A:
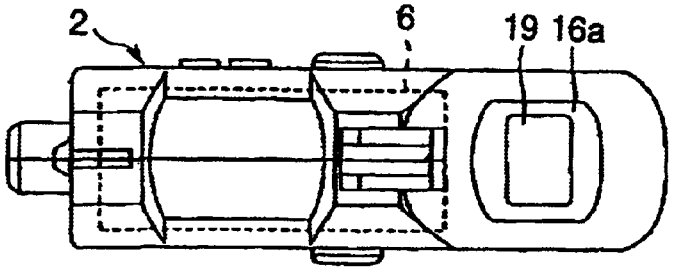
FIGS. 1(*a*), 1(*b*) and 1(*c*) are external views of a gun-shaped controller according to Embodiment 1 of the present invention.
Figure 1B:
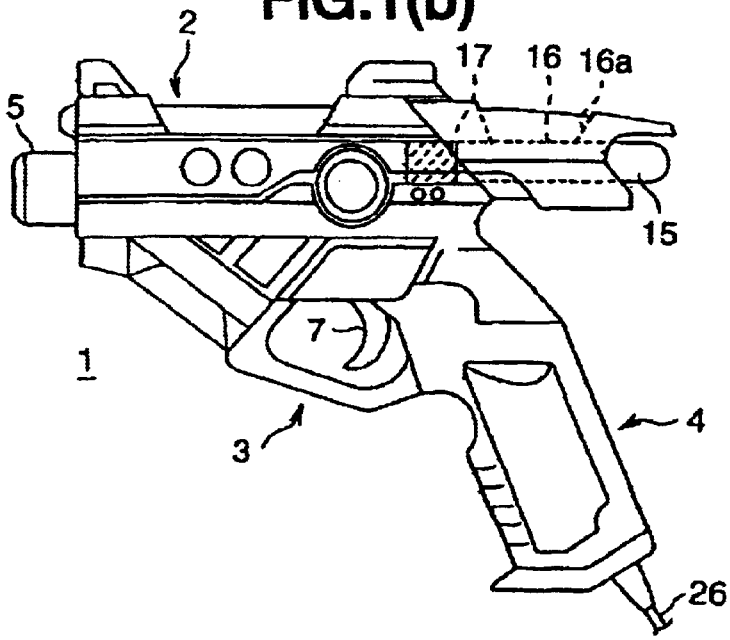
Figure 1C:
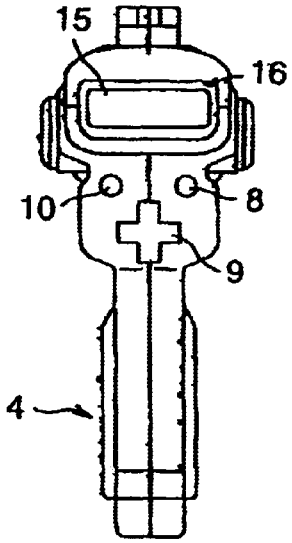

The gun-shaped controller according to Embodiment 1 of the present invention is now explained with reference to FIGS. 1(*a*) through 4. FIGS. 1(*a*) and 1(*b*) show the exterior of a gun-shaped controller to be operated by a player and connected to a video game machine.

As shown in FIG. 1(*a*), the controller 1 is structured of a gun barrel 2 and a trigger 3 in order to imitate a gun.

An artificial retinal unit 5 for reading the game image from the monitor screen (not shown) is provided at the tip of the gun barrel. Prescribed image processing is performed on the game image read here and input to the controller circuit 6 (not shown in FIGS. 1(*a*) and 1(*b*)) explained later. A trigger lever 7 structuring the operation portion of the controller is mounted on the trigger 3 so as to be movable with respect to the controller and operable with the player's finger.

Moreover, the trigger lever 7 may be structured of a switch for outputting on/off or a switch for outputting analog values in accordance with the control input.

In the present embodiment with a gun-shaped controller structured as mentioned above, a start switch 8, a cross-shaped directional key 9 to be manually operated by a player as an operation key, and a reload switch 10 are provided to the upper part of the grip 4 of the controller 1, which corresponds to the hammer of an actual gun.

The start switch 8 is for turning on the functioning of the controller upon starting a game. The cross-shaped directional key 9 is similar to a cross-shaped directional key provided on a general game controller and is used for arbitrarily changing the direction of the character with the player's finger operation and moving the cursor to an arbitrary position on a selective screen. The reload switch 10 is used for loading bullets into a gun, which is conducted by a player pressing this reload switch.

The start switch 8, cross-shaped directional key 9, and reload switch 10 are connected to the controller circuit 6 as with the trigger lever 7, and the signals corresponding to the key operations are input to the control circuit.

Accordingly, the gun-shaped controller according to the present embodiment provides various operations from the player's side by incorporating, in addition to the trigger lever 7, a cross-shaped directional key 9 to be operated by the player. This enables complex operations in a gun game and not just simply shooting enemies appearing on the screen.

The player-side character, a police officer character for example, may be displayed separately on a small screen within the monitor screen, moved in an arbitrary direction with the operation of the cross-shaped directional key 9, and the arrangement of background and enemies of the main screen may be changed in accordance therewith. This enables compatibility with complex shooting game software. Moreover, options on characters and weapons to be used by the characters may be provided and arbitrarily selected with the operation of the cross-shaped directional key 9. Thus, this controller may be used for game software such as role-playing games and adventure games.

By providing a start switch 8, cross-shaped directional key 9, and reload switch 10 on the upper part of the grip of the controller 1, the player may, for example, operate the start switch 8, cross-shaped directional key 9, and reload switch 10 with his/her thumb while operating the trigger lever with his/her index finger. That is, a so-called single-handed action may be used in operating this gun-shaped controller.

As shown in FIG. 1(*c*), the gun-shaped controller according to the present embodiment is provided with a slot 16 for inserting a below-described memory card with LCD, as a game peripheral, at the tail of the gun barrel of the controller. This slot 16 is formed along the lengthwise direction of the gun barrel, and a connector 17 to be connected to a memory card 15 is provided on the bottom thereof. A window 16*a* is formed on the upper part of this slot 16. From this window 16*a*, the LCD 19 of the memory card 15 inserted into this slot 16 can be viewed.

The memory card 15 is mounted on the gun-shaped controller and is used, for example, as a memory for storing the hit/miss information of the shooting from the gun-shaped controller or as an external display means for notifying the player of such results. In addition, this memory card 15 maybe used as a simple game device even if removed from the controller 1 by loading a mini game thereinto.

Figure 2:
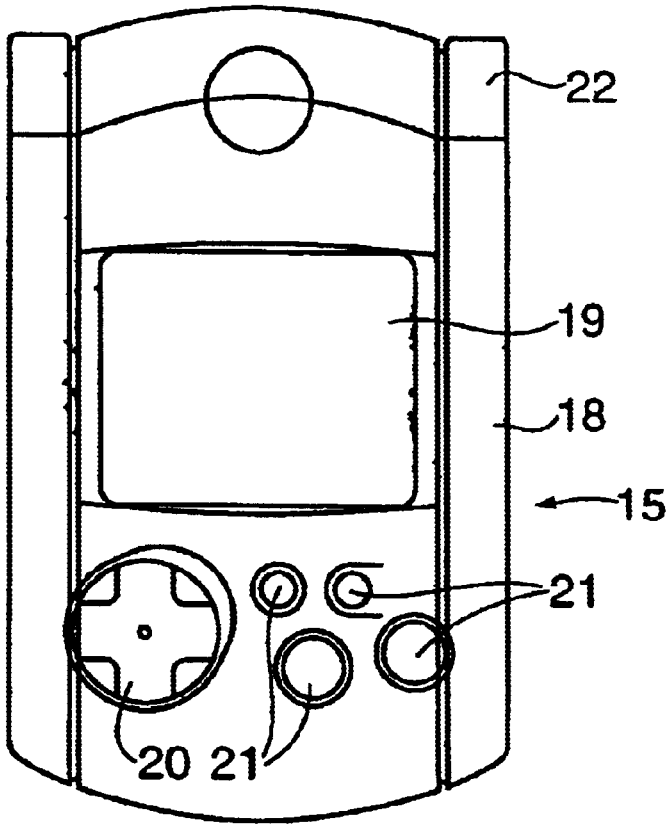
FIG. 2 is an external view of a memory card with LCD and capable of being mounted on to the gun-shaped controller shown in FIG. 1.

As shown in FIG. 2, this memory card 15 is provided with a small LCD portion 19 on the upper surface of its case 18. A cross-shaped directional key 20 and a plurality of operation buttons 21 are provided on the lower part thereof. When using the memory card 15 independently, it is possible to provide to the cross-shaped directional key 20 a selection key function and a save key function for inputting information and saving it in the memory. An external connection terminal (not shown) for connection with a connector 17 on the controller side is provided on the upper inner side of the case 18. This external connection terminal is ordinarily covered with a cap 22 for protection from dust and the like, and such cap is removed upon the terminal being connected to the gun-shaped controller.

Figure 3:
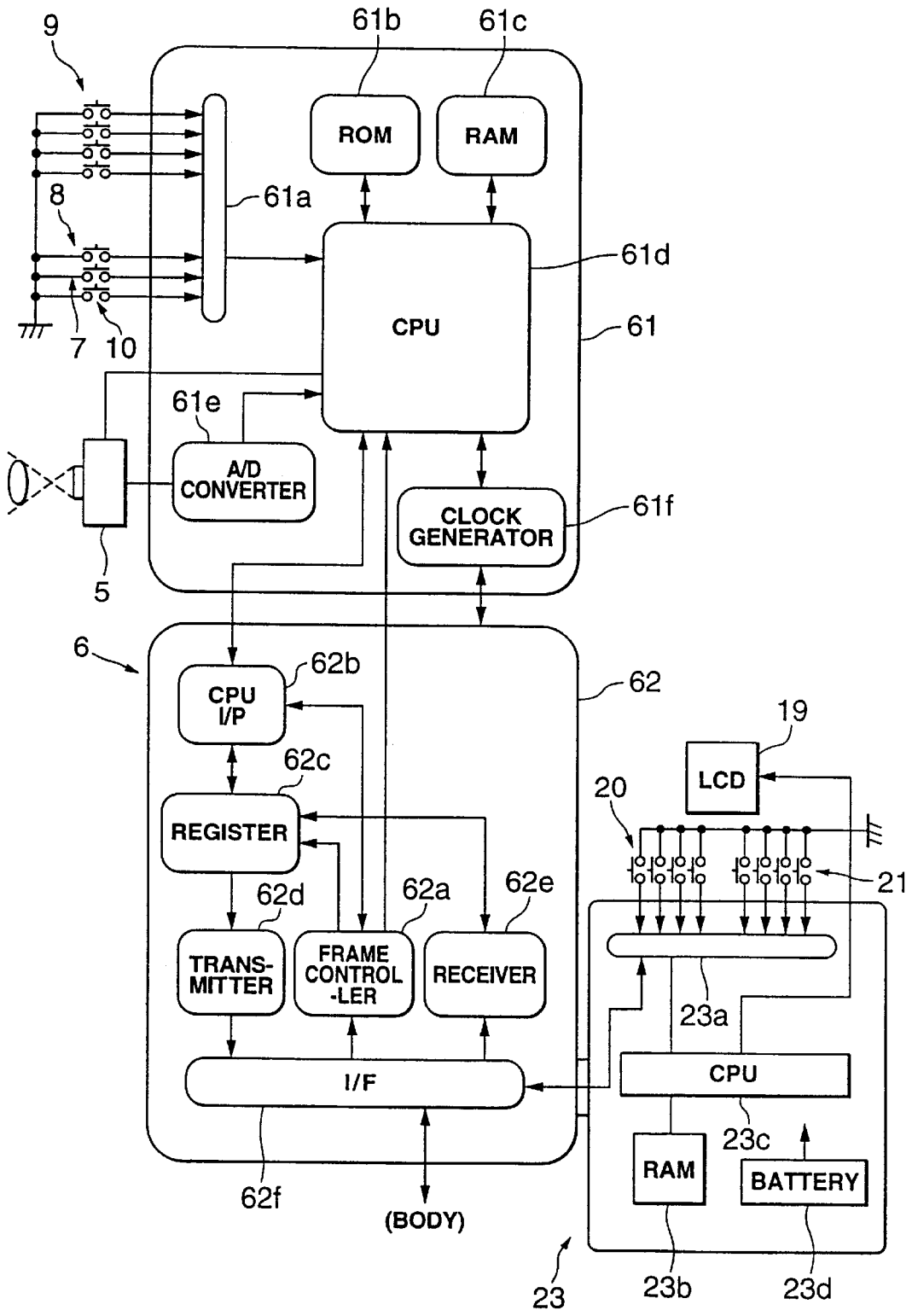
FIG. 3 is a block-structure diagram of a control circuit of the gun-shaped controller shown in FIG. 1.

FIG. 3 is a block diagram of the structure of the controller circuit 6 to which the operation information of the aforementioned various operation portions, namely the trigger lever 7, start switch 8, cross-shaped directional key 9, and reload switch 10, from the player are input. This FIG. 3 is a block diagram of the structure whereby the memory card 15 has been mounted.

The controller circuit 6 is structured of a CPU 61 and a control unit 62, which is a gate alley. The CPU 61 is provided with, as a basic structure, a ROM 61*b*, RAM 61*c*, CPU 61*d*, and clock generator 61*f*. The CPU 61 is further provided with an input port 61*a* for inputting various operation signals from the trigger lever 7, start switch 8, and cross-shaped directional key 9, and an A/D converter 61*e* for converting analog image signals from the artificial retinal unit 5 into digital signals.

The control unit 62 connected to the CPU 61 comprises a frame controller 62*a*, CPU interface 62*b*, register 62*c*, transmitter 62*d*, receiver 62*e*, and interface 62*f* which structures an information input/output port between a game machine and a memory card 15.

the control circuit 23 of the memory card 15 is provided with, as a basic structure, a RAM 23*b* and CPU 23*c*. The control circuit 62 is further provided with an I/O port 23*a* for inputting various operation signals from the operation button 21 or LCD driving signals from the control circuit 6, and for outputting signals to the interface 62*f* of the LCD 19 and control circuit 6. The control circuit 23 and LCD 18 are driven with a battery 23*d*.

According to the present embodiment, as a connector 17 is provided to the controller 1 for the installation of the memory card, various functions, such as saving and loading the player data by using the memory, may be provided to the controller via the aforementioned memory card 15. Furthermore, by using the LCD 19 of the memory card 15, for example, it is possible to display a simple map or to represent the position of the enemy not appearing on the monitor screen. It is also possible to use a memory card with built-in speakers and output game sounds therefrom and not only from the monitor.

By this, it is possible to breakaway from conventional shooting games of merely aiming and shooting at targets and to provide variations to the game progress itself. The gun-shaped controller of the present embodiment is thus compatible with highly entertaining game software.

Figure 4:
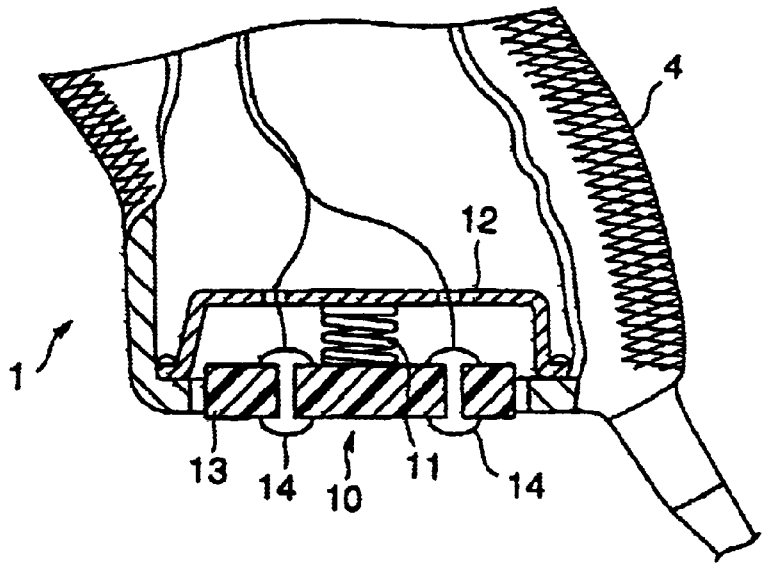
FIG. 4 is a partial cross section of a reload mechanism provided to the grip portion of the gun-shaped controller shown in FIG. 1.

Although the gun-shaped controller according to the present embodiment is provided with a reload switch 10 for the player to reload bullets into a gun, as shown in FIG. 4, a reload unit 10, which is a virtual bullet-loading device using the contact sensor, may be provided on the grip 4.

As shown in FIG. 4, this reload unit 10 is structured of a sensor holder 13 supported by a unit case 12 via a spring 11 so as to be vertically movable with respect to the grip 4, and a pair of continuity-type contact sensors embedded under this holder 13. The continuity between the contact sensors is detected with the controller circuit 6.

By providing this type of reload unit 10 on the lower part of the grip 4 (at the butt of a gun), compatible game software may require the player to reload the bullets by hitting the butt of the gun with the palm of his/her hand upon running out of a prescribed number of ammunition.

Moreover, the game mode for which this unit 10 may be used is not limited to merely the contact/non-contact between the sensors, but may also be a type where the sensor continuity time of the player is counted, and the power or the number of loaded bullets is increased in proportion to the length of the continuity time. By this, for example, weapons such as the "Wave Motion Gun" of SF movies requiring an energy charge prior to firing may be used. It is therefore possible to provide a new type of amusement by being able to destroy all enemies on the screen with a single blast.

Figure 5A:
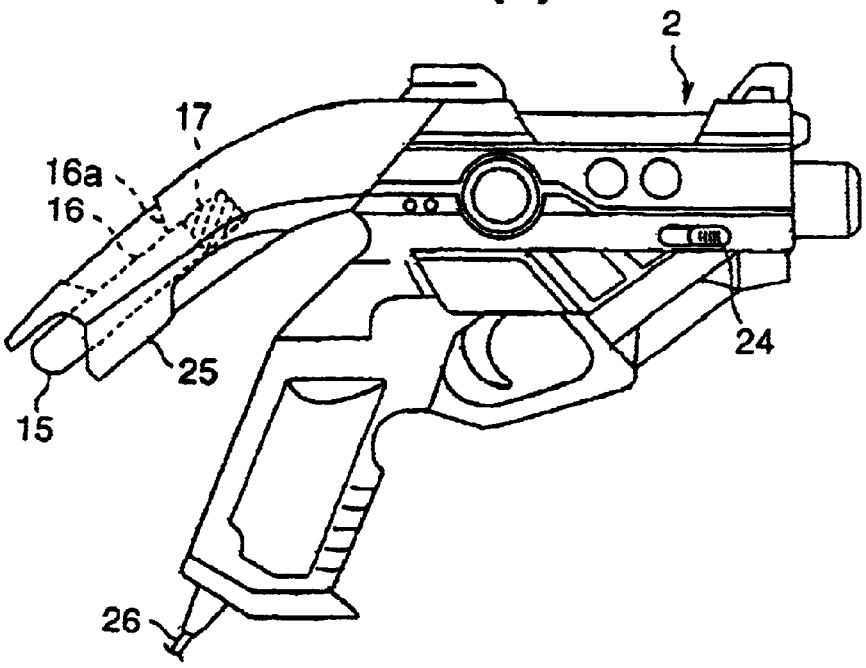
FIGS. 5(*a*) and 5(*b*) are external views of the gun-shaped controller according to Embodiment 2 of the present invention.
Figure 5B:
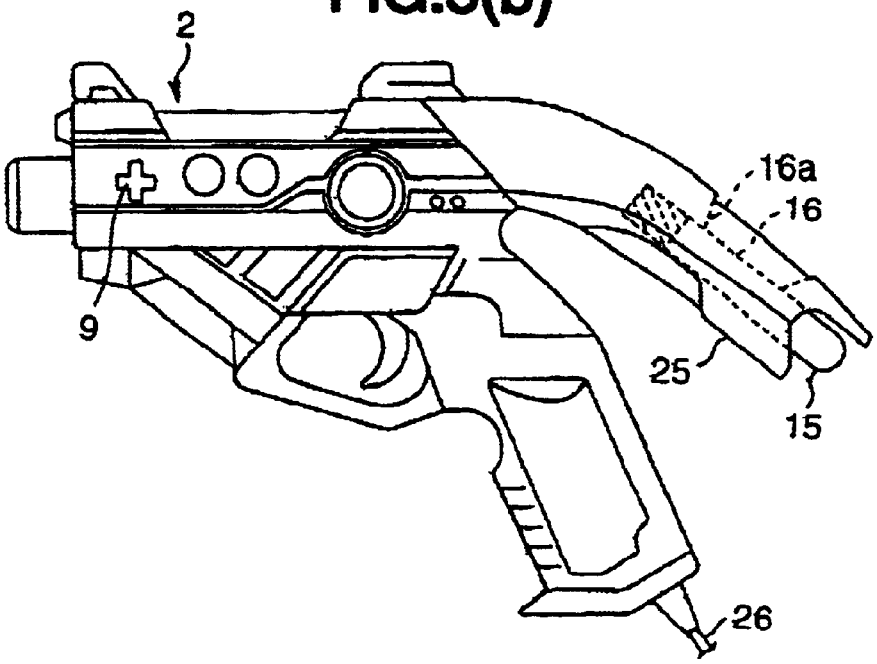

The gun-shaped controller according to Embodiment 2 of the present invention is now explained with reference to FIGS. 5(*a*) and 5(*b*). Although the reload switch 10 is arranged at the upper part of the grip 4 of the controller 1 in aforementioned Embodiment 1, in the present embodiment, a reload lever 24 is established slidably with respect to the side of the gun barrel 2 of the controller 1 as shown in FIG. 5(*a*). The player slides this reload lever 24 to reload bullets. In this case, the operation of the reload lever 24 by the player will be as though sliding a forearm of the gun barrel, in other words, it will be similar to an actual shooting action of pulling the sliding lever of an automatic-type gun.

Although the cross-shaped directional key 9 is provided at the upper part of the grip 4 in Embodiment 1, in the present embodiment, the cross-shaped directional key 9 is arranged on the side in the vicinity of the tip of the gun barrel 2 as shown in FIG. 5(*b*). In this case, it is possible to operate the trigger lever 7 with one hand while operating the cross-shaped directional key 9 with the other hand, thereby enabling a secure operation of the gun-shaped controller with a double-handed action.

As shown in FIGS. 5(*a*) and 5(*b*), the position of the slot 16 for inserting the memory card 15 to be mounted on the controller 1 is structured such that the tail potion 25 of the gun-shaped controller itself is extended in a lower diagonal direction and the slot 16 is provided on this tail and the memory slot 15 may be mounted at a position near the player's side. In such case, it is easier for the player to view the LCD of the memory card 15.

The gun-shaped controller according to Embodiment 3 of the present invention is now explained with reference to FIG. 6. Although the controllers of the aforementioned embodiments all have connector cables 26 for connection with the game machine extending from the lower part of the grip 4, in the present embodiment, such cables 26 are extending from the tip of the controller's tail 25 additionally provided in a lower diagonal direction. By this, interference between the reload unit 10 and the connector cable 26 of the grip 4 is avoided, and the reloading operation is improved.

In the gun-shaped controller according to the present embodiment, a connector 17 is provided at the lower part of the slot 16 to be mounted from the upper part of the memory card 15. The memory card 15 is inserted from the upper part of the slot 16 and is connected to the connector 17.

Figure 6:
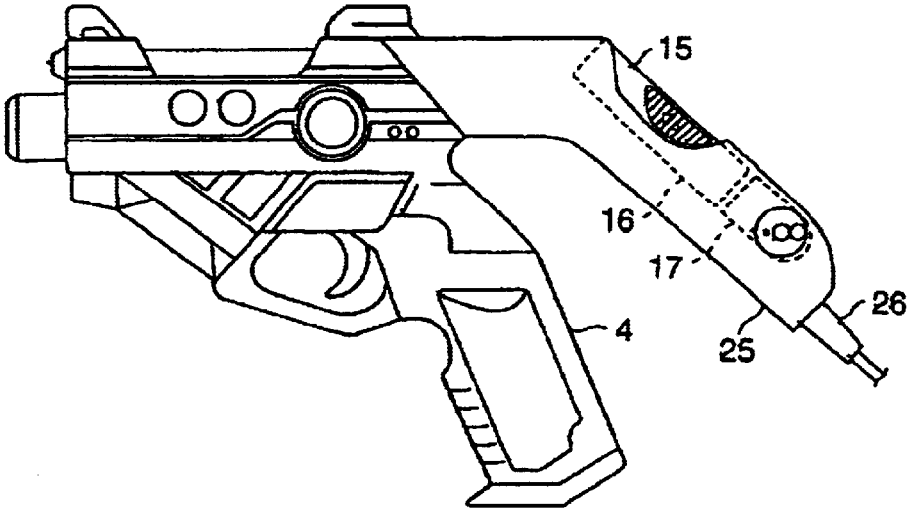
FIG. 6 is an external view of the gun-shaped controller according to Embodiment 3 of the present invention.

In FIG. 6, by securing the space between the tail 25 and the grip 4 as wide as possible, the freedom of the player's operation may be enhanced.

Figure 7:
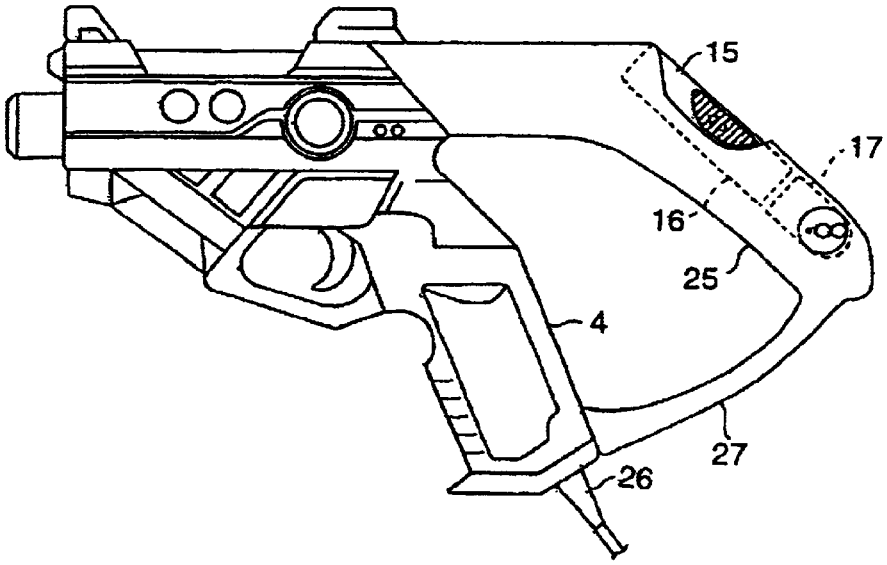
FIG. 7 is an external view of the gun-shaped controller according to Embodiment 4 of the present invention.

The gun-shaped controller according to Embodiment 4 of the present invention is now explained with reference to FIG. 7. In the present invention, the grip and the tail are linked with a bridge 27. By this, it is possible to reinforce the strength of the gun-shaped controller without interfering with the player's operation.

The gun-shaped controller according to Embodiment 5 of the present invention is now explained with reference to FIGS. 8(*a*) through 10. These figures show the exterior view of the gun-shaped controller to be operated by a player and connected to a video game machine.

Figure 8A:
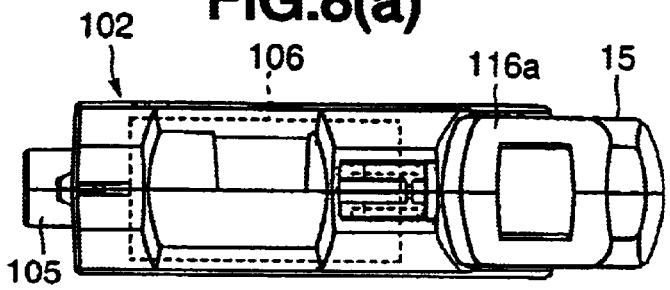
FIGS. 8(*a*), 8(*b*) and 8(*c*) show a gun-shaped controller according to Embodiment 5, and FIGS. 8(*a*) through 8(*c*) are external views respectively showing a top, side, and rear thereof.
Figure 8B:
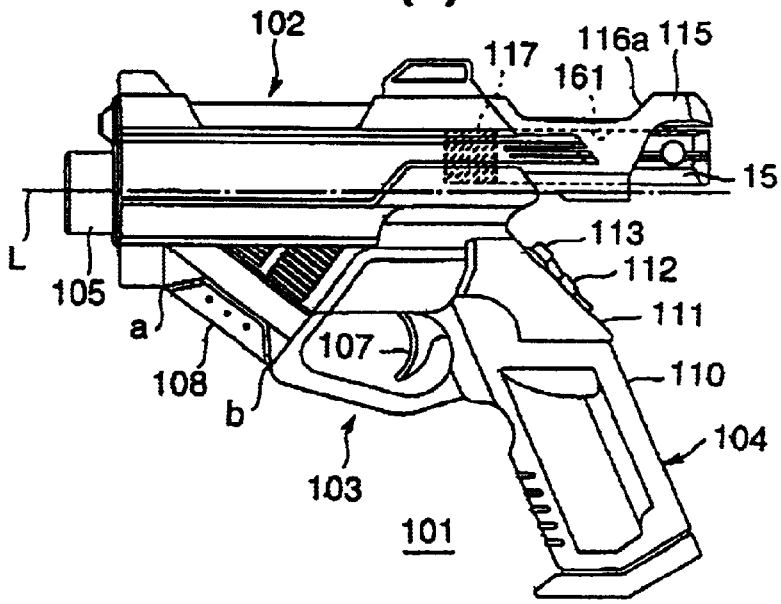
Figure 8C:
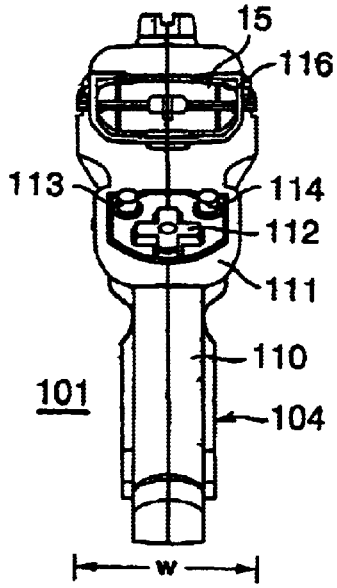
Figure 9A:
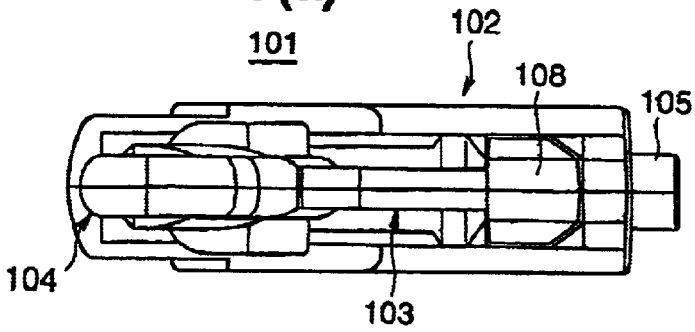
FIGS. 9(*a*), 9(*b*) and 9(*c*) show the gun-shaped controller according to Embodiment 5, and FIGS. 9(*a*) through 9(*c*) are external views respectively showing the bottom, side, and front thereof; respectively showing the bottom, side, and front thereof.
Figure 9B:
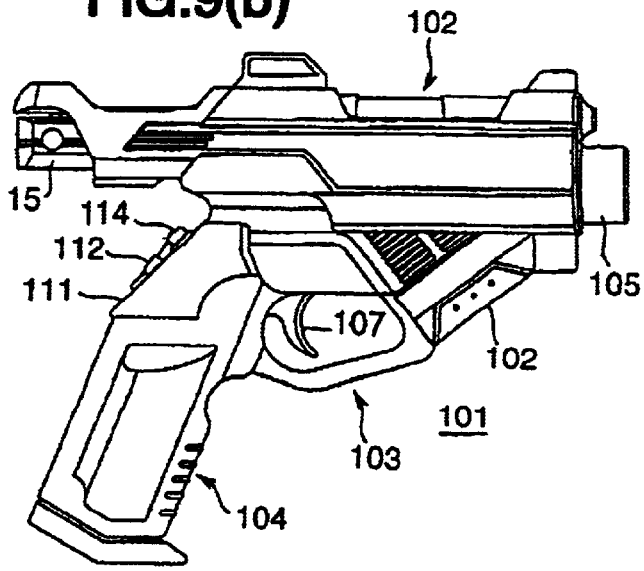
Figure 9C:
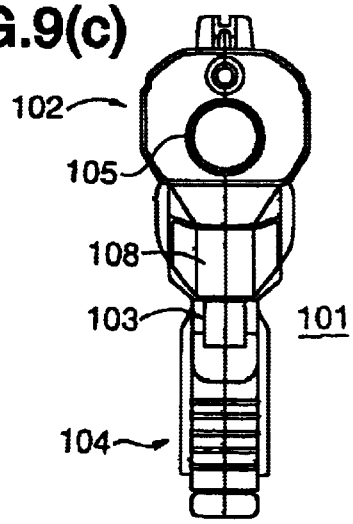

Similar to each of the aforementioned embodiments, the controller 1 in the present embodiment also imitates a gun by being structured of a gun barrel 102, trigger 103, and grip 4 as shown in FIG. 8(*b*).

An artificial retinal unit 105 for reading the game image from the monitor screen (not shown) is provided at the tip of the gun barrel 102. Prescribed image processing is performed on the game image read here and input to the built-in controller circuit 106. Explanation of the control circuit 106 is omitted as it is the same as the control circuit 6 described in FIG. 3. A trigger lever 107 structuring the operation portion of the controller is mounted on the trigger 103 so as to be movable with respect to the controller 101, and is operable with the player's finger. The single chain line shown as L in FIG. 8(*b*) is the lengthwise axis extending through the center of the artificial retinal unit 105 in the lengthwise direction of the gun barrel 102.

Figure 10:
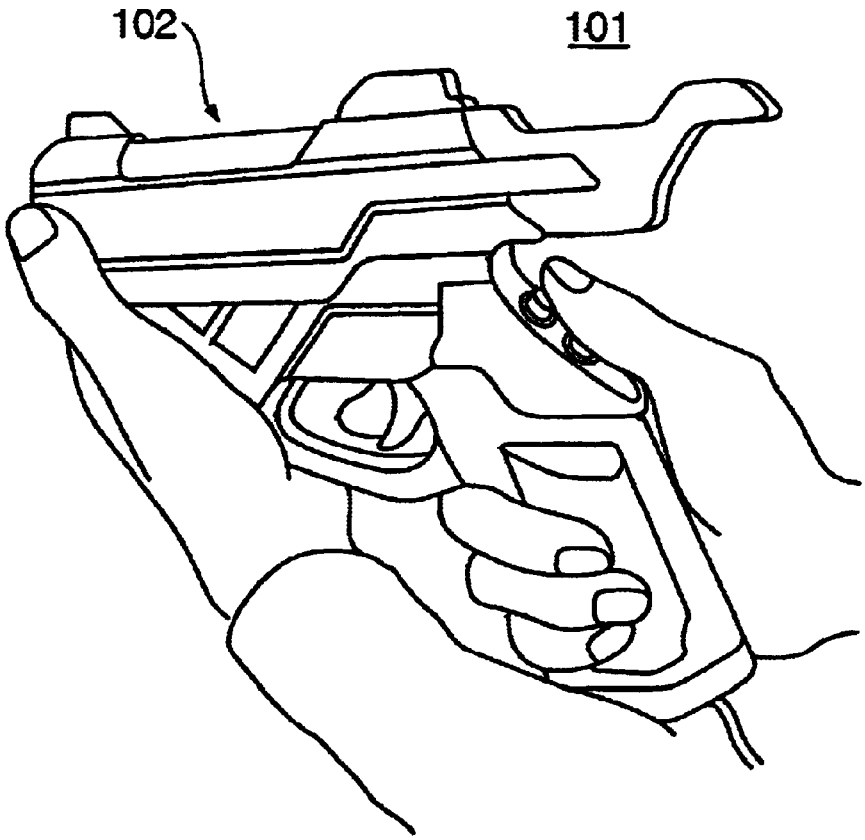
FIG. 10 shows an operation example of the gun-shaped controller shown in FIG. 8 and FIG. 9.

In the gun-shaped controller as structured above according to the present embodiment, the lower face 108 of the gun barrel 102 is structured diagonally with respect to the lengthwise axis L of the gun barrel, from the lower face position a in the vicinity of the tip of the gun barrel to the connection point b with the trigger 103. As shown in FIG. 10, for example, this structure is formed under the presumption that the player will hold the gun barrel 102 of the controller 101 with the other hand in order to improve the gun's aiming precision, and the holdability of the gun barrel itself is improved by inclining the lower face 108.

Figure 11:
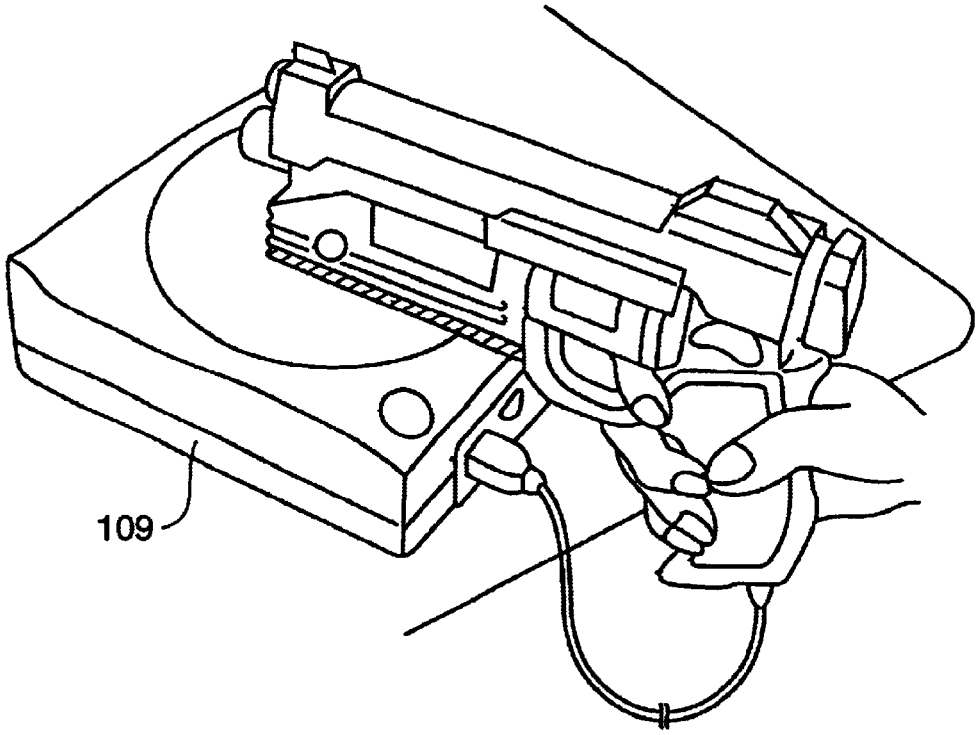
FIG. 11 shows an operation example of a conventional gun-shaped controller.

In order to improve the holdability, a player may shoot the gun while placing it directly on the video game machine 109 as shown in FIG. 11 (reference figure), which is not preferable in terms of the video game machine. By inclining the lower face 108 in the present embodiment, the object of avoiding this type of game play is also achieved.

Similar to the aforementioned embodiments, an operation face 111 is arranged on the upper part of the grip 104 of the controller 101 continuously to the rear face of the grip 104 and inclined toward the tip of the gun barrel rather than the rear face 110, and various buttons 113, 114 such as the cross-shaped directional key 112 and start button are provided thereto.

The cross-shaped directional key 112 is similar to a cross-shaped directional key provided on a general game controller and is used for arbitrarily changing the direction of the character with the player's finger operation and moving the cursor to an arbitrary position on a selective screen. Considering the operability of this cross-shaped directional key 112, when the controller 101 is positioned so that the lengthwise axis L of the gun barrel becomes horizontal, the key 112 is position higher than the tip of the trigger 1ever 107 and, as shown in FIG. 8(*c*), is positioned approximately in the center of the gun barrel direction shown with the arrow W when viewed from the rear of the gun.

The various buttons 113, 114 such as the start button are arranged to be symmetrical on the cross-shaped directional key 112 as positioned above. By this position relationship, when the player moves his/her subject of operation from the cross-shaped directional key 112 to the various operation buttons 113, 114 such as the start button, the muzzle of the gun naturally moves outside the screen (mainly downward) by the shift in finger movement pursuant thereto. As a result, it is possible to avoid erroneous operation of the controller, such as accidental shooting on the screen pursuant to the button operation, which often occurs with inexperienced players.

With respect to game functions furnished by these various operation buttons 113, 114 such as the start button, due to the reasons mentioned above, it is not preferable to assign frequently used functions thereto. From that viewpoint, the frequently used reload function, for example, may be achieved by the player shooting outside the screen as conventionally without depending on button operations.

The various operation buttons 113, 114 and the cross-shaped directional key 112 are, in the same manner as the trigger lever 107, connected to the controller circuit 106, and signals corresponding to key operations are input to the control circuit 106.

As with the aforementioned embodiments, a slot (mounting portion) 116 for inserting a memory card (memory device) 15 with LCD, as a game peripheral, is provided to the tail portion 115 of the gun barrel of the controller 101. This slot 116 is formed in the lengthwise axis L direction of the gun barrel 2, and a connector 117 for connection with the memory card 15 is provided at the bottom portion thereof. A window 116*a* is formed on the upper part of the slot 116. From this window 116*a*, the LCD indicator 19 of the memory card 15 inserted into the slot 116 can be viewed.

By extending the rear of the gun barrel and providing a slot 116 on the upper part of the cross-shaped directional key 112 as above, it is possible to avoid the muzzle of the gun from leaning downward as the centroid of the controller 101 moves toward the rear when the memory card is inserted.

As the upper part of the cross-shaped directional key 112 and the various operation buttons 113, 114 such as the start button are covered with the inserted memory card 15, the external appearance of the gun is not ruined. By providing a peripheral-mounting portion to the rear of the gun barrel 102, the player can easily insert the peripheral. In addition, when a peripheral such as a vibration pack is mounted, it is possible to more effectively vibrate the gun in comparison to if it were to be mounted on the front of the gun.

The present invention is not limited to the aforementioned embodiments and may be used in various other applications.

For example, although the shown controller 1, 101 is formed by imitating a short-nose type gun, it is not limited to such shape, and may be a normal-nose gun, or long-nose type guns such as shotguns and rifles.

The game device according to Embodiment 6 of the present invention is now explained with reference to FIGS. 12 and onward. Foremost, FIGS. 12 through 22 are drawings to explain the hardware of the game device according to the embodiments of the present invention.

Figure 12:
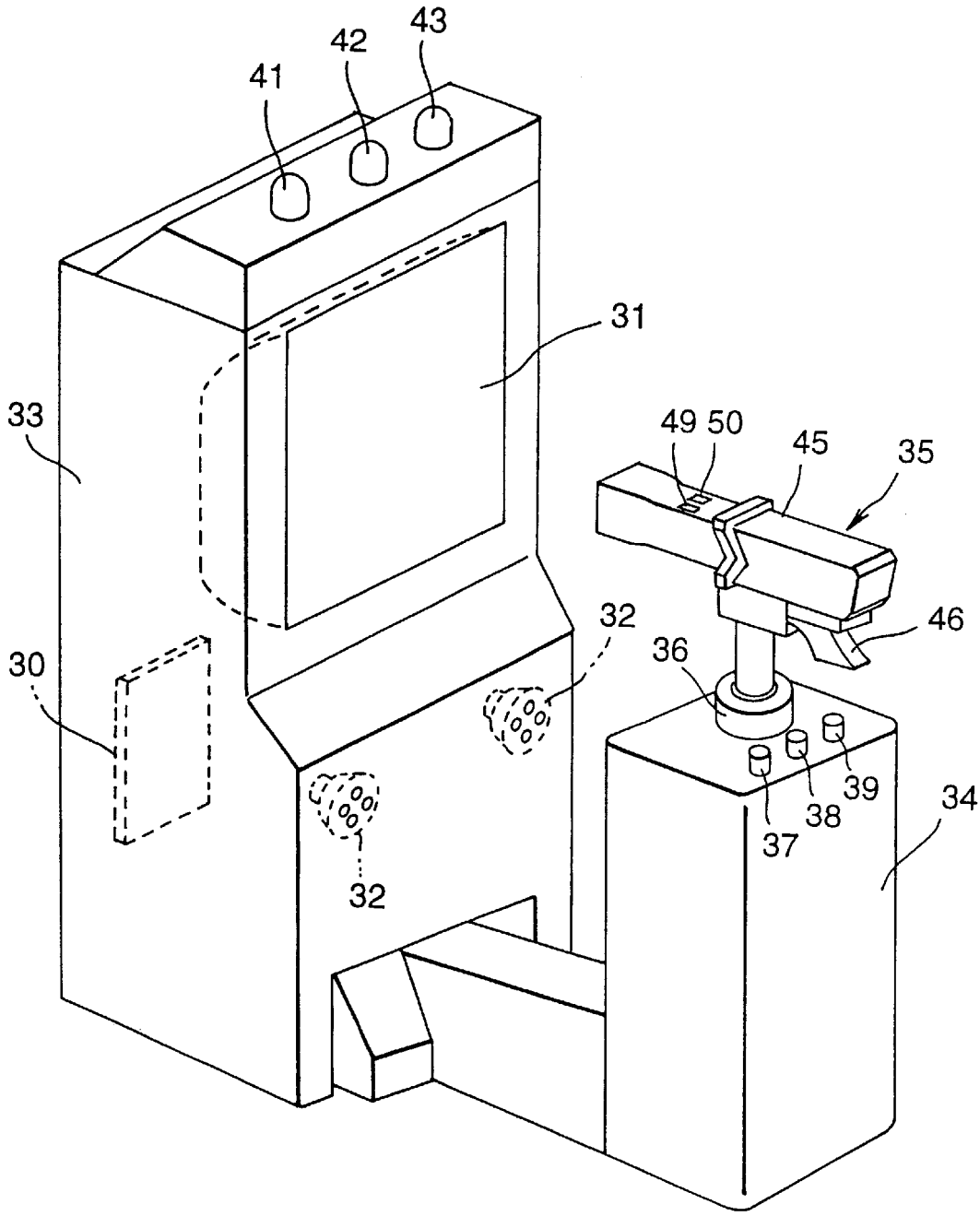
FIG. 12 is a perspective diagram showing the overall game device.

FIG. 12 is a perspective view showing the overall game device. In this FIG. 12, the game device is comprised of, as a basic structure, a game processing board 30, a housing 33 with a built-in monitor 31 which is a displaying means and speakers 32, 32, and a gun-shaped controller rotatably secured, via a supporting mechanism 36, to a pedestal 34 arranged in front of the monitor 31 of the housing 33. This game machine forms game images in the style wherein an enemy character shown within a screen displayed on the monitor 31 which is a display means, and a main character which moves and attacks within the screen of the monitor under the operation of the gun-shaped controller battle each other, and these game processing steps are performed with the aforementioned game processing board.

The gun-shaped controller 35 supported rotatably on the pedestal 34 is formed, for example, in a shape imitating a bazooka as shown in FIG. 12, and the structure thereof is later explained.

Operation buttons 37, 38, 39 are arranged on the upper part of the pedestal, at the rear of the gun barrel of the gun-shaped controller 35. These operation buttons 37, 38, 39 are enabled push operation with a predetermined number of strokes, and are colored, for example, as blue, yellow and red. These operation buttons 37, 38, 39 structure a part of the virtual bullet-loading portion (explained in detail later) capable of virtually loading bullets with the push operation of these operation buttons.

Three indicators 41, 42, 43 are provided on the housing 33. These indicators 41, 42, 43 are the same color as the three operation buttons 37, 38, 39 provided on the pedestal and are provided in the same arrangement as such operation buttons. These indicators 41, 42, 43 either light up or turn off in accordance with the operation of the operation buttons 37, 38, 39. In other words, the indicators 41, 42, 43 light up in blue, yellow and red.

Figure 13:
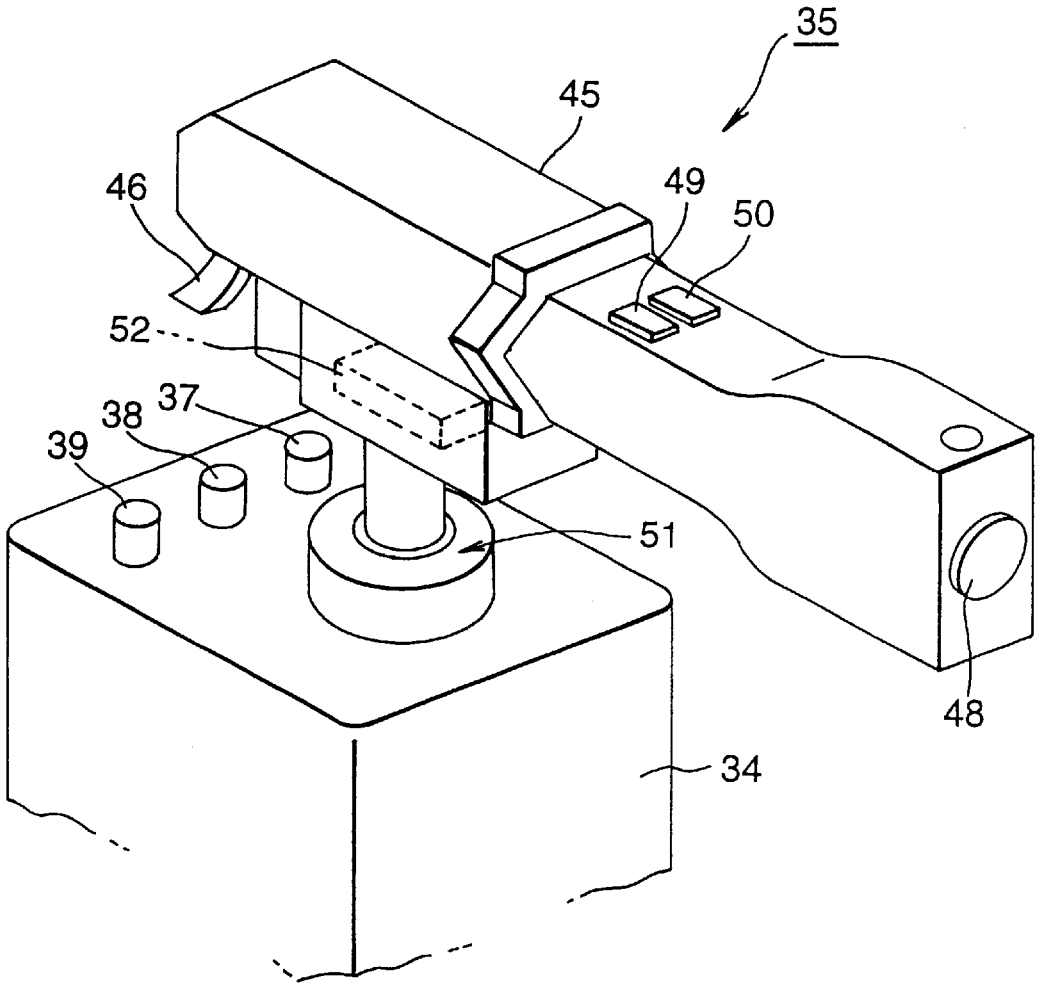
FIG. 13 is a perspective diagram showing the portion in which the gun-shaped controller and pedestal is associated.
Figure 14:
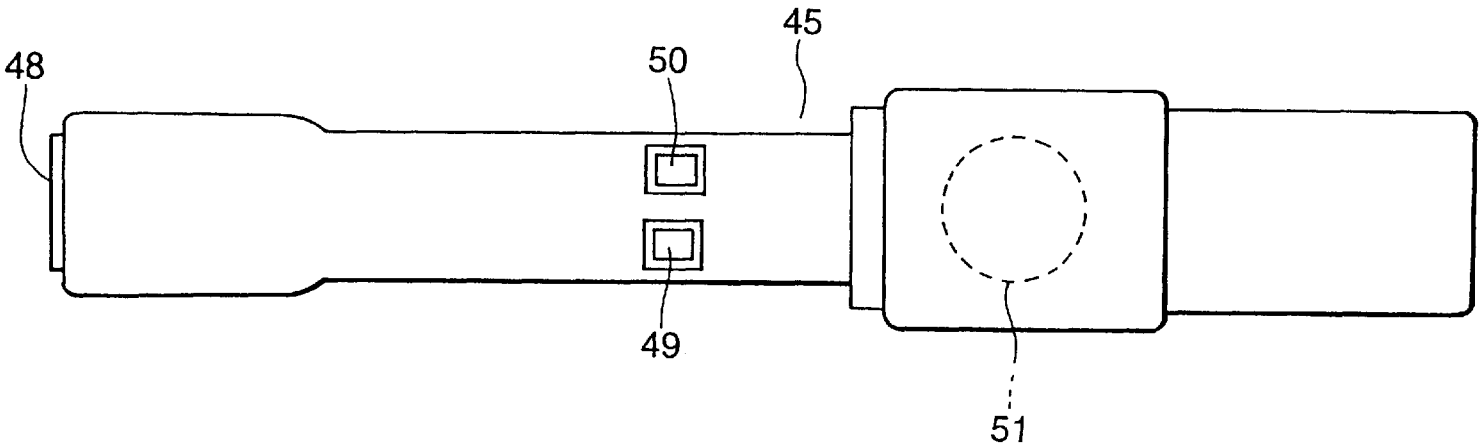
FIG. 14 is a plan view showing a gun-shaped controller.
Figure 15:
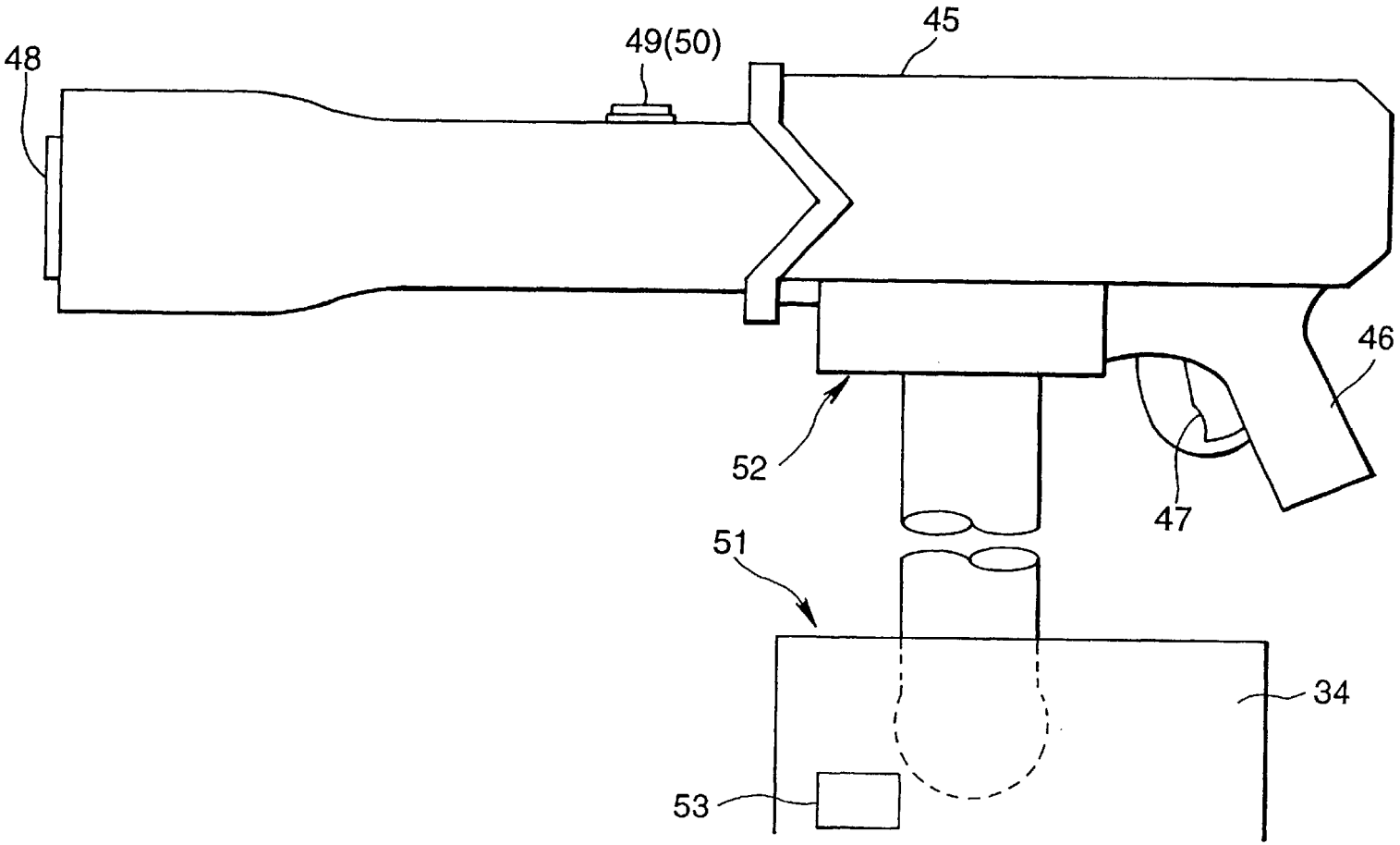
FIG. 15 is a side view showing a gun-shaped controller.
Figure 16:
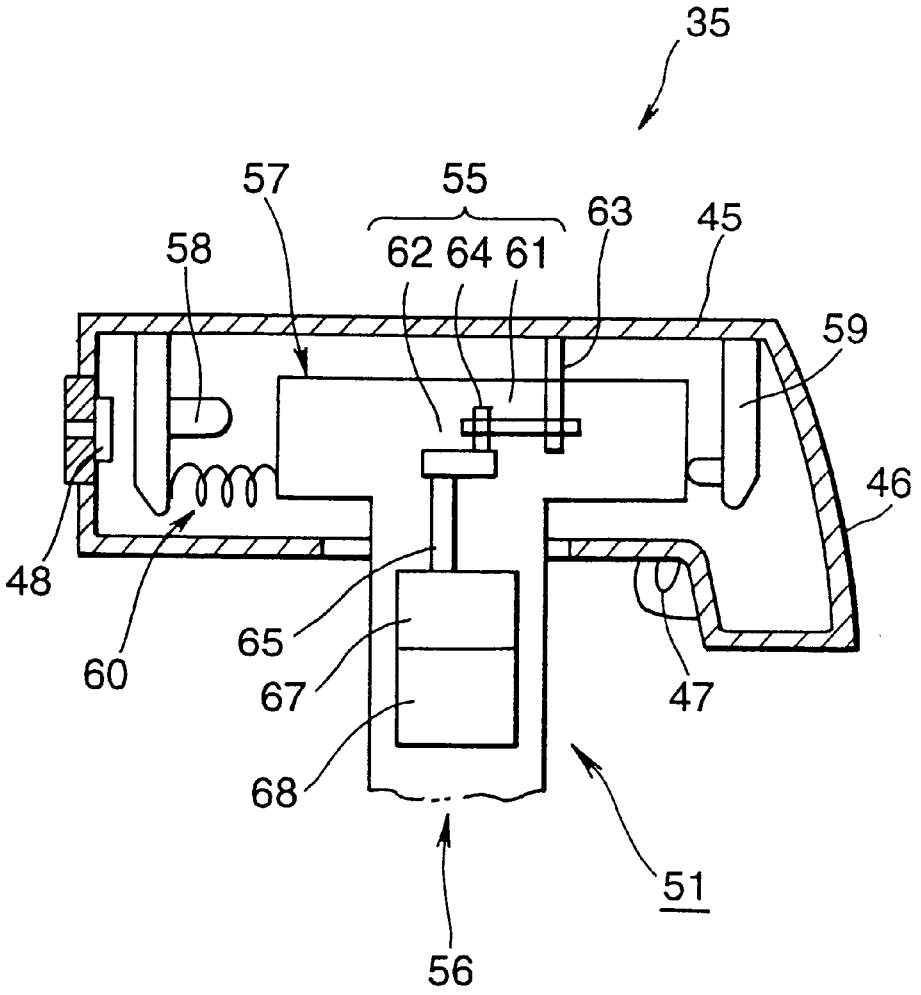
FIG. 16 is a typical diagram showing the internal mechanism of a gun-shaped controller.
Figure 17:
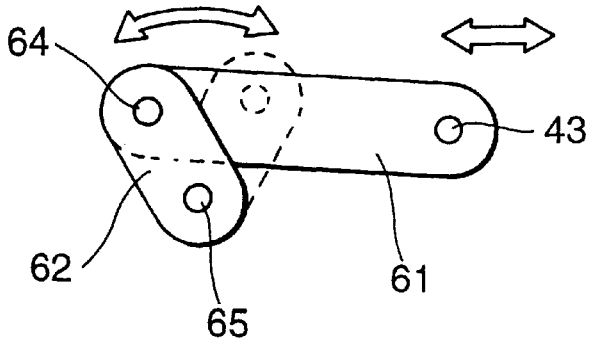
FIG. 17 is a plan view showing an enlargement of the rotation/reciprocation conversion mechanism within the recoil mechanism inside the gun-shaped controller.

FIGS. 13 through 17 are used to explain the gun-shaped controller to be used with the game device and to the structural portions of this gun-shaped controller. Here, FIG. 13 is a perspective diagram showing the portion relating to the gun-shaped controller and the pedestal. FIG. 14 is a plan view showing the gun-shaped controller, FIG. 15 is a side view showing the gun-shaped controller, FIG. 16 is a typical diagram showing the internal structure of the gun-shaped controller, and FIG. 17 is a plan view showing the enlarged rotation/reciprocation converter mechanism within the recoil mechanism inside the gun-shaped controller.

The gun-shaped controller 35 comprises a gun barrel 45, grip 46 to be heldby the operator, trigger lever 47 to be operated by the operator, light detecting means 48 for obtaining light detection signals for detecting the position on the screen of the monitor 31 provided to the front portion of the gun barrel 45, directional keys 49, 50 provided to the upper part of the gun barrel 45 for instructing the main character to move left or right, supporting mechanism 51 for rotatably supporting the gun barrel 45 on a pedestal 34, recoil mechanism 52 for providing recoil to the gun barrel 45 when the cannonball is fired, and signal processing means 53 for transmitting predetermined instruction signals according to the operation and transmitting light detection signals from the light detecting means 48.

The recoil mechanism 52 of the gun-shaped controller 35 comprises a movable mechanism 54, rotation/reciprocation conversion mechanism 55, power source 56, and is structured as follows.

Regarding the movable mechanism 54, a slide rail 57 reciprocally supports the gun barrel 45 and supporting mechanism 51. Stoppers 58, 59 are provided to the left and right of the gun barrel 45 in prescribed intervals as shown in Fig. 16, and the slide rail moves between these stoppers 58, 59. In the gun barrel 45, the slide rail 57 comes in contact with the stopper 59 by being biased in one direction (leftward in FIG. 16) by a coil spring 60, which is an elastic member. Reciprocation from the rotation/reciprocation conversion mechanism 55 is supplied to this movable mechanism 52.

The rotation/reciprocation conversion mechanism 55 is comprised of a link 61, cam 62 and other structural components. One edge of the link 61 is rotatably attached to an axis 63 secured to the gun barrel 45. The other edge of the link 61 is rotatably attached to the cam 62 with the axis 64. The cam 62 is secured to the rotational axis 63 of the power source 56. By this, in the rotation/reciprocation conversion mechanism 55, the link 61 reciprocates in the direction of the arrow in FIG. 17 by the cam 62 rotating in the direction of the arrow in FIG. 17.

The power source 56 is comprised of a clutch 67 and motor 68. The cam 62 is secured to the output rotational axis 65 of the clutch 67. The clutch 67 and motor 68 are integrally formed, and, as well as being able to rotate the motor 68 by supplying power thereto, the power source is able to supply rotational power to the output rotational axis 65 by connecting the clutch 67 with operation signals.

Figure 18:
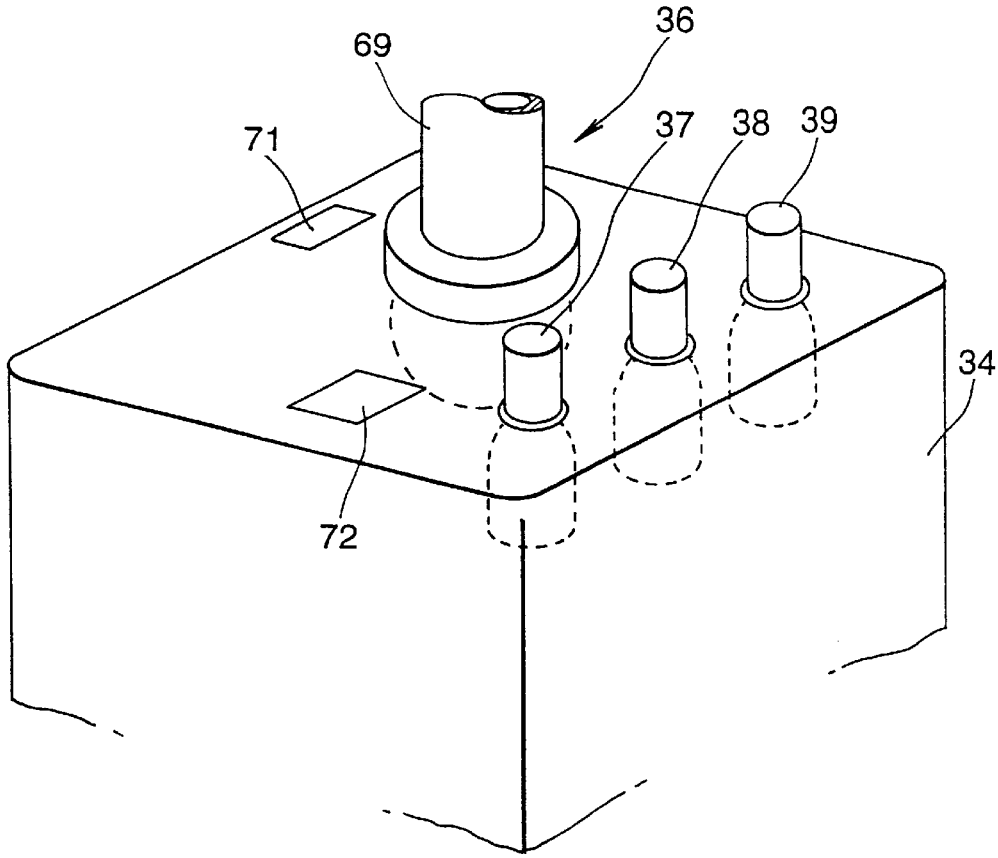
FIG. 18 is a perspective diagram showing an enlargement of the pedestal.
Figure 19:
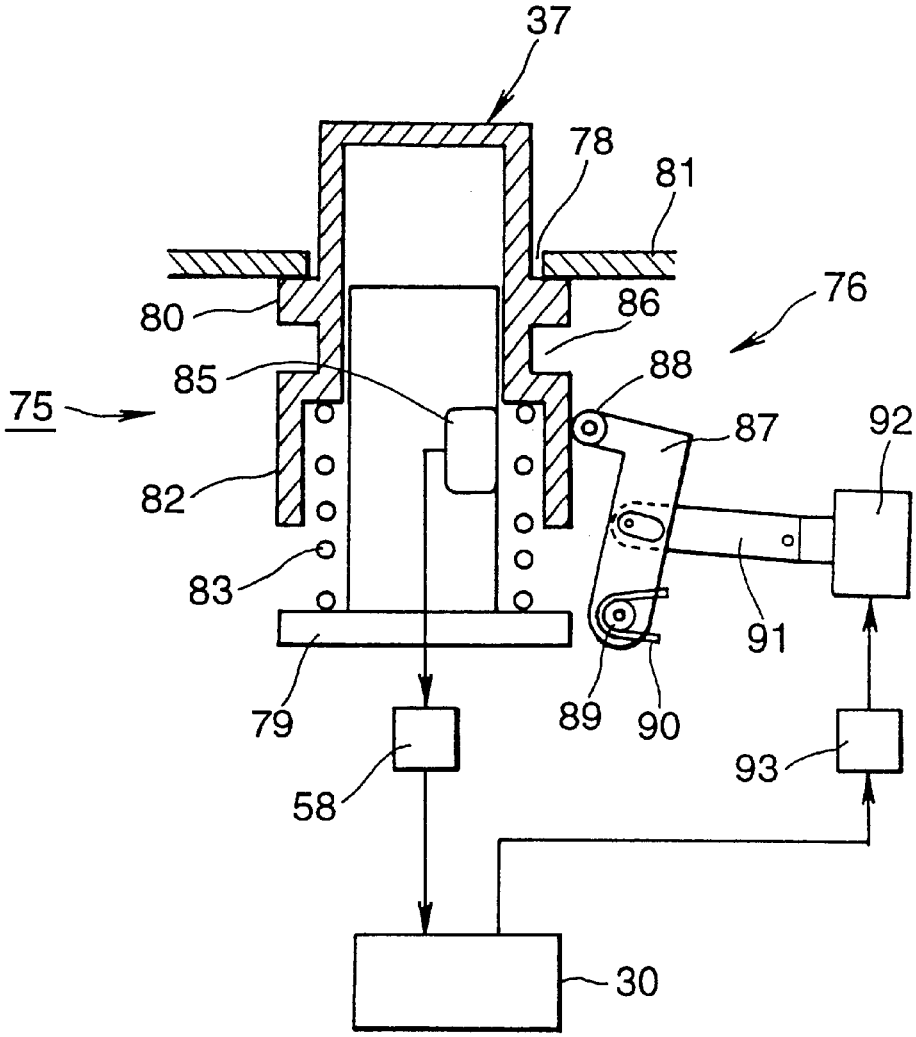
FIG. 19 is a concrete structural diagram of the virtual bullet-loading portion including the operation button.

FIG. 18 and FIG. 19 are diagrams for explaining the relationship of the mechanisms arranged on the pedestal. The pedestal is foremost explained. FIG. 18 is a perspective view showing an enlargement of the pedestal portion. In this FIG. 18, provided to the pedestal 34 are a supporting mechanism 36, three operation buttons 37, 38, 39, and sensors 71, 72 for detecting the direction in which the gun barrel is facing (horizontal and vertical directions) from the movement of the axis 69 of the supporting mechanism 36. The operation buttons 37, 38, 39 are colored blue, yellow, and red.

FIG. 19 is a concrete structural diagram of the virtual bullet-loading portion including the operation buttons. In this FIG. 19, as the virtual bullet-loading portions respectively including the operation buttons 37, 38, 39 are of the same structure, the virtual bullet-loading portion using operation button 37 is representatively explained.

The virtual bullet-loading portion 75 comprises an operation button, to which push operation of predetermined strokes is enabled, for transmitting operation signals of such push operation, locking mechanism for locking the operation button when the operation button is pushed a prescribed number of strokes, and unlocking mechanism for unlocking the operation button when a cannonball is fired by the operation of the trigger lever, and is structured as follows.

This operation button 37 comprises a hollow cylindrical shape, and is inserted into an engagement hole of the pedestal 34 from under and protrudes therefrom as shown in FIG. 19. A guide 79 is inserted inside the hollow cylinder of this operation button 37 and is movable in the vertical direction as shown in FIG. 19. A flange 80 is formed in the center of the cylinder of the operation button 37, and this flange is made to come in contact with the pedestal 34 and the wall 81. The lower part of the cylindrical operation button 37 is, as shown in the FIG. 19, provided with a large diameter portion 82 formed to be of a larger diameter in a prescribed size in comparison to the guide 82, and a coil spring 83 is arranged in the inner periphery thereof. The coil spring 83 is arranged between the upper end of this large diameter and the edge of the guide 79 as shown in FIG. 19, and pushes the operation button 37 upward. A switch 85 is arranged inside the guide 79, and this switch is turned on when the operation button 37 has been push-operated a predetermined number of strokes.

The locking mechanism 76 and the unlocking mechanism 77 are structured as follows. That is, a groove 86 is formed between the flange 80 and the large diameter portion 82. To this groove 86, a guide roller 88 of a latch 87 is inserted, and the operation button is thereby locked. The latch 87 is rotatably secured to the pedestal 34 by the rotational axis 89. The latch 87 is biased toward the operation button 37 side by the spring 90. Therefore, when the groove 86 arrives at the guide roller 88 upon the operation button 37 being pushed, the latch 87 is pressed by the spring 90, and the guide roller 88 engages with the groove 86 and the operation button 37 is thereby latched. This latch 87 is linked to a solenoid 92. When this solenoid 92 is drawn in, the guide roller 88 disengages from the groove 86, and the operation button 37 thereby moves upward by the working of the coil spring 83.

The switch 85 is connected to the signal processing circuit 58. This signal processing circuit 58 is connected to the game processing board 30. The solenoid 92 is connected to a solenoid driving circuit 93, and the solenoid 92 is excited by the drive of the solenoid driving circuit 93. The operation of this solenoid driving circuit 93 is controlled by the drive signals from the game processing board 30.

Figure 20:
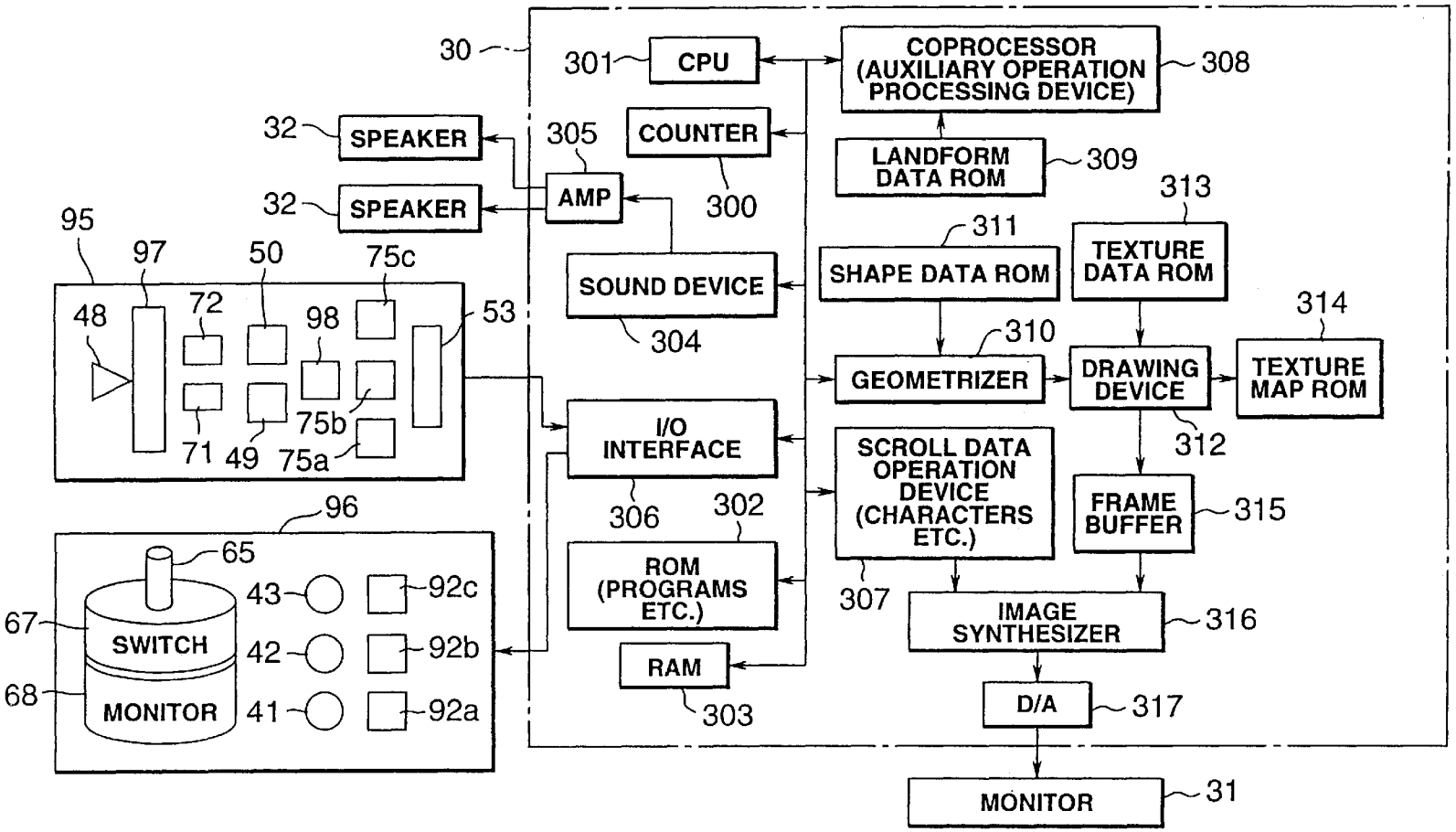
FIG. 20 is a block diagram showing the structure a game processing board and its peripheral circuits of the game device.
Figure 21:
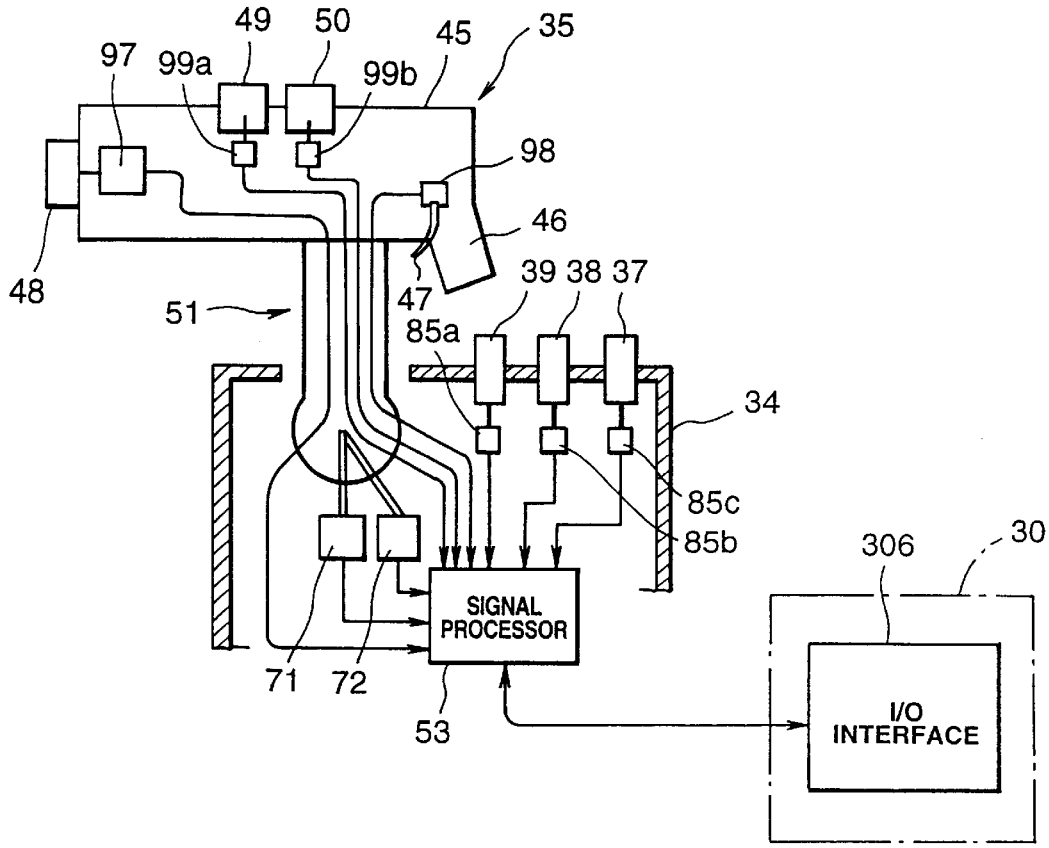
FIG. 21 is a block diagram showing the structure of an input device.
Figure 22:
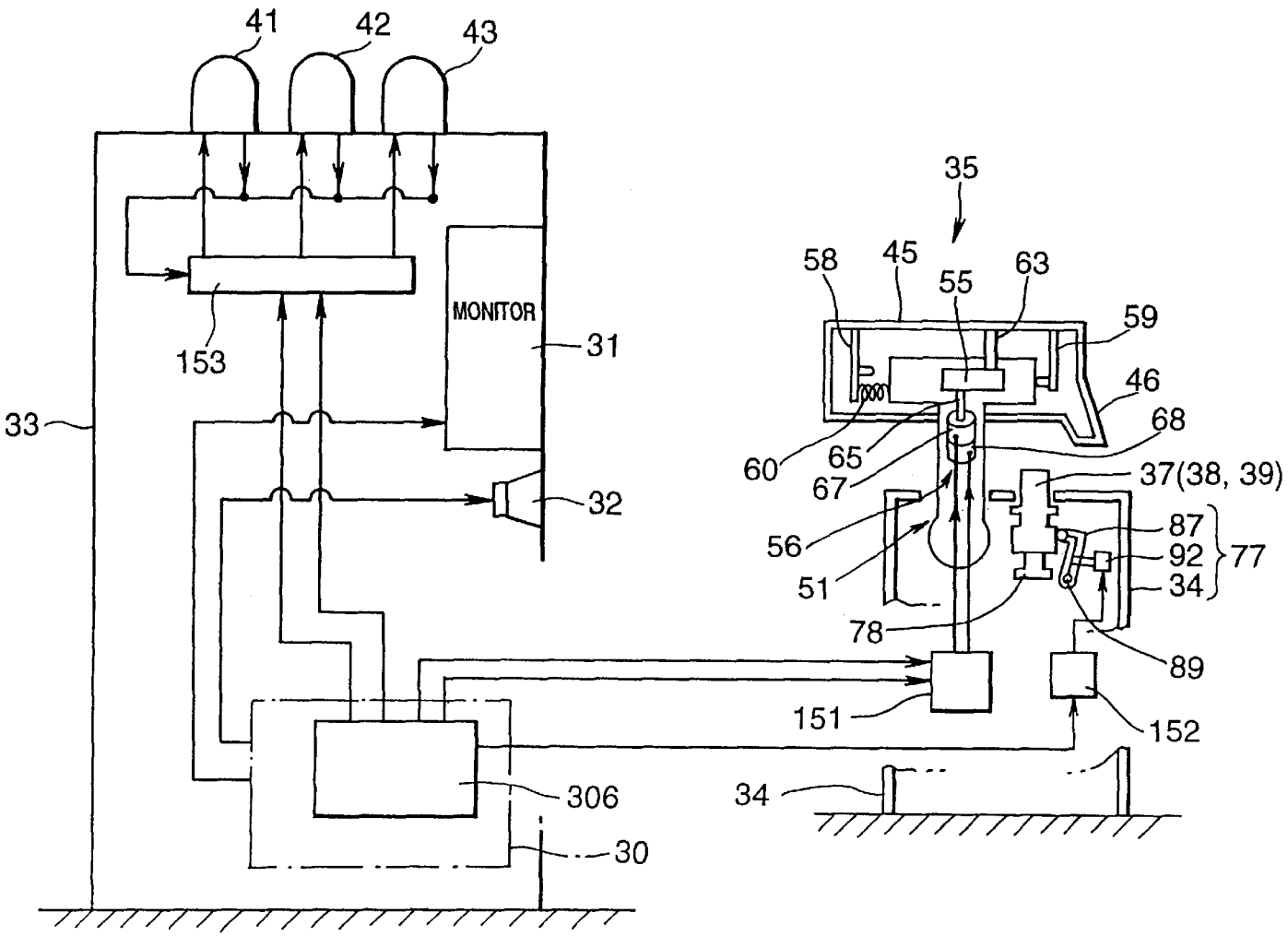
FIG. 22 is a block diagram showing the structure of an output device.

FIGS. 20 through 22 are diagrams for explaining the signal processing system of the game device.

FIG. 20 is a block diagram showing the structure of the game processing board and its peripheral circuit of the game device. In FIG. 20, this game device is comprised of, as a basic structure, a game processing board 30, input device 95 inclusive of the gun-shaped controller 35 for inputting instruction signals, output device 96 for applying recoil to the gun-shaped controller 35 and lighting and turning off the indicators 41, 42, 43, monitor 31, and speakers 32, 32.

The input device is comprised of a light detecting means 48, preamp 97 for amplifying the detection signals of the light detection means 48, sensors 71, 72, directional keys 49, 50, trigger switch 98 for detecting the trigger of the trigger lever 47, virtual bullet-loading portions 75*a*, 75*b*, 75*c*, signal processing circuit 53 and auxiliary circuits thereof.

The game processing board 30 comprises a CPU (central processing unit) 301 as well as a ROM 302, RAM 303, sound device 304, I/O interface 306, scroll data operation device 307, coprocessor (auxiliary operation processing device) 308, landform data ROM 309, geometrizer 310, shape data ROM 311, drawing device 312, texture data ROM 313, texture map RAM 314, frame buffer 315, image synthesizing device 316, and D/A converter 317. The sound circuit is comprised of an amplification circuit (AMP) 305 for amplifying sound signals from the sound device 304.

The CPU 301 is connected to the ROM 302 storing prescribed programs via a bus line, RAM 303 storing data, sound device 304, I/O interface 306, scroll data operation device 307, coprocessor 308, and geometrizer 310. The RAM 303 functions as a buffer, and performs writing of various commands (display of objects, etc.) to the geometrizer 310, matrix writing upon conversion matrix operation (e.g., scaling of explosion pictures explained later), and so on.

The I/O interface 306 is connected to the input device 95 and output device 96. Thereby, the CPU 301 reads instruction signals and light signals of the input device 95 as digital quantity, and the signals generated by the CPU 301 are output to the output device. The output of the sound device 304 is connected to the speakers 32, 32 via an amplification circuit (AMP) 305, and the sound signals generated by the sound device 304 are provided to the speakers 32, 32 after amplification.

In the present embodiment, the CPU 301 reads operation signals from the gun-shaped controller 35 and virtual bullet-loading portion 75 based on the program built in the ROM 302, and landform data from the landform data ROM 309 or shape data from the shape data (three-dimensional data of "objects such as the main character and enemy character" and "backgrounds such as routes, landforms, skies, buildings") from the ROM 311. The CPU 301 thereby performs, at the least, collision judgment between the landform and a cannonball fired from the gun held by the main character or the cannonball fired by the enemy character, pseudo semitransparent processing of the scroll screen, action calculation (simulation) of cars upon judgment processing of lock-on and the like, modification processing of the shape of objects, enlargement/reduction calculation of explosions and the like as special effects.

Image processing of the main character simulates the movement of the main character in the virtual space according to the operation signals from the gun-shaped controller 35 or virtual bullet-loading portion 75. After the coordinate values within the three-dimensional space are determined, conversion matrix for converting these coordinate values into the visual field coordinate system and shape data (main character, enemy character, landform, buildings, etc.) are designated by the geometrizer 310. The landform data ROM 309 is connected to the coprocessor 308 and, therefore, predetermined landform data and the like are delivered to the coprocessor 308 (and CPU 301). The coprocessor 308 mainly performs judgment on the impact of the fired cannonball and, upon such judgment and simulation of the cannonball, mainly assumes the operation of floating decimal points. As a result, the collision judgment between the cannonball and enemy character or other buildings is performed by the coprocessor 308 and such judgment result is provided to the CPU 301. Thus, the calculation load of the CPU is decreased, and the collision judgment can be performed more rapidly.

The geometrizer 310 is connected to the shape data ROM 311 and drawing device 312. The shape data ROM 311 stores in advance polygon shape data (three-dimensional data such as the main character, enemy character, landforms, and backgrounds structured of each of the vertexes), and this shape data is delivered to the geometrizer 310. The geometrizer 310 performs perspective conversion to the shape data designated by the conversion matrix sent from the CPU 301, and obtains data converted from the coordinate system within the three-dimensional space to the visual field coordinate system.

The drawing device applies texture to the shape data of the converted visual field coordinate system and outputs this to the frame buffer 315. In order to apply the texture, the drawing device 312 is connected to the texture ROM 313 and the texture map RAM 314, as well as to the frame buffer 315. Here, polygon data shall mean a data group of relative or absolute coordinates of each vertex of a polygon (polygon: mainly triangles or quadrilaterals) structured of an aggregate of a plurality of vertexes. In the landform data ROM 309, stored is polygon data set relatively roughly, which will suffice upon performing the collision judgment between the cannonball etc. fired from the cannon of the main character and the enemy character or point of impact. Contrarily, stored in the shape data ROM 311 is polygon data set accurately relating to the shapes forming the images of the main character, enemy character, explosion pictures, and backgrounds.

The scroll data operation device 307 is for operating scroll screen data such as characters, and this operation device 307 and frame buffer 315 arrive at the display 6 via the image synthesizing device 316 and D/A converter 317. By this, polygon screens (simulation effects) of the main character, enemy character and landform (background) temporarily stored in the frame buffer 315, and scroll screens such as character information necessary for display are synthesized according to priority, and the final frame image data is generated. This image data is converted to analog signals with the D/A converter 317 and sent to the monitor 31, and the game image is displayed in real time.

FIG. 21 is a block diagram showing the structure of the input device mentioned above. In this FIG. 21, arranged inside the gun-shaped controller are a light detecting means 48 for detecting the position of impact, preamp 97 for amplifying the light signal of this light detecting means 48, directional keys 49, 50 and trigger lever 47. Provided to the trigger lever 47 is a trigger switch 98 for converting operation signals of such trigger lever to electric signals. Similarly, provided to the directional keys 49, 50 are directional switches 99*a*, 99*b* for converting operation signals of such trigger lever to electric signals. The output of the preamp 97 is connected to the digital input port of the signal processing circuit 53. Similarly, the output of the trigger switch 98 and the output of the directional switches 99*a*, 99*b* are respectively connected to the digital input port of the signal processing circuit 53.

Operation buttons 37, 38, 39 are arranged on the pedestal 34. Switches 85*a*, 85*b*, 85*c* are provided to the operation buttons 37, 38, 39. These switches 85*a*, 85*b*, 85*c* are for converting the operation signals of the operation buttons 37, 38, 39 to electric signals. The switches 85*a*, 85*b*, 85*c* are connected to the digital input port of the signal processing circuit 53. Sensors 71, 72 are provided to the base of the supporting mechanism 51, and are capable of detecting the direction in which the gun-shaped controller is facing (horizontal direction, vertical direction) and converting such direction to analog signals. These sensors 72 are connected to the analog port of the signal processing circuit 53.

The signal processing circuit 53 may be of a one-chip CPU structure, and is capable of supplying to the I/O interface 306 of the game processing board 30 these input signals upon changing them into prescribed signal format. Here, a one-chip CPU is a CPU structured in a single chip wherein an operation processing device, RAM, ROM, digital input port, analog input port, data output port, etc. are structured integrally.

FIG. 22 is a block diagram showing the structure of the output device mentioned above. In this FIG. 22, the output device 96 is comprised of a clutch 67 and motor 68 of the recoil mechanism 55 of the gun-shaped controller and the driving circuits thereof, a solenoid 92 of the unlocking mechanism 77 of the virtual bullet-loading portion 75 and the driving circuit 152 thereof, indicators 1, 42, 43 arranged on the housing 33 and the driving circuits 153 thereof. These driving circuits 151, 152, 153 are connected to the I/O interface 306 of the game processing board 30, and form driving signals pursuant to orders from the game processing board 30.

Figure 23A:
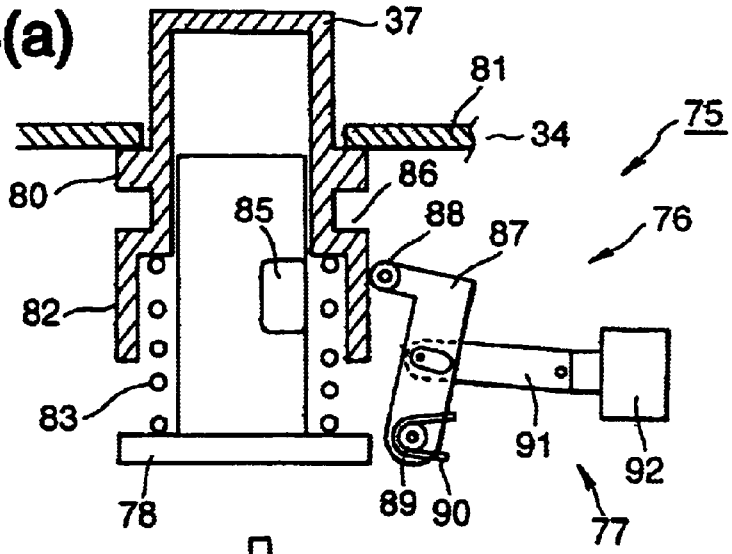
FIGS. 23(*a*), 23(*b*) and 23(*c*) are diagrams for explaining the motion of the virtual bullet-loading portion, and FIGS. 23(*a*) through 23(*c*) respectively show the condition when the operation button is not pushed, is locked with the push-lock mechanism, and is unlocked with the unlocking mechanism.
Figure 23B:
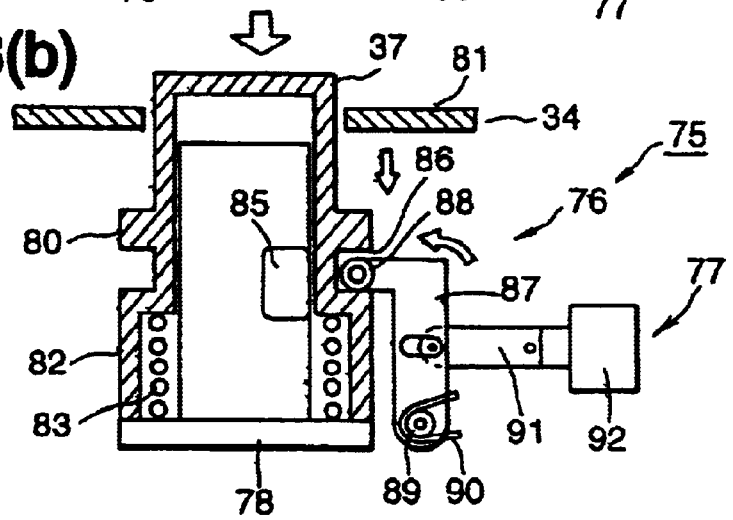
Figure 23C:
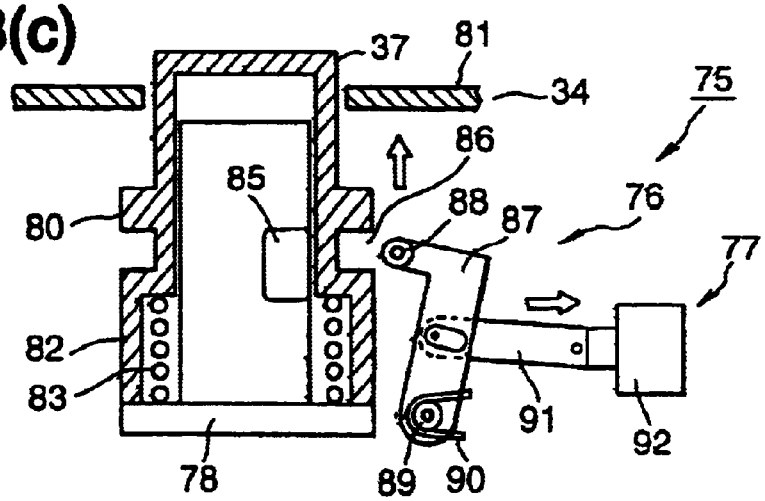

FIGS. 23(*a*), 23(*b*) and 23(*c*) are diagrams for explaining the operation of the virtual bullet-loading portion, and FIGS. 23(*a*) through 23(*c*) respectively show the condition when the operation button is not pushed, is locked with the push-lock mechanism, and is unlocked with the unlocking mechanism.

Figure 30:
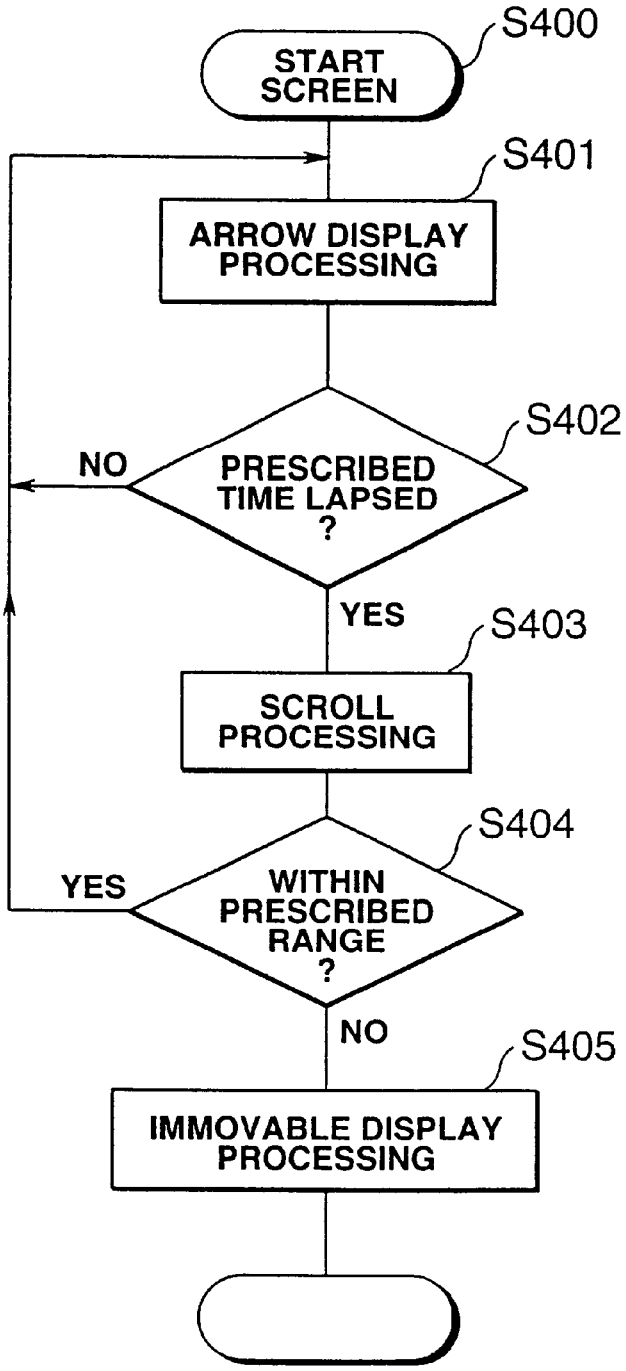
FIG. 30 is a flowchart showing the processing flow upon moving a character according to the present embodiment.
Figure 31A:
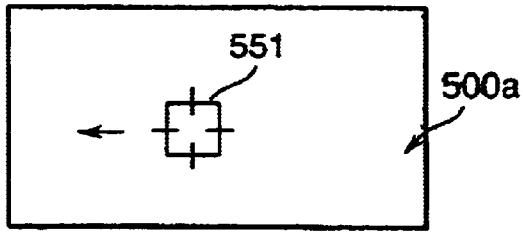
FIGS. 31(*a*), 31(*b*), 31(*c*), 31(*d*), 31(*e*) and 31(*f*) are diagrams showing an example of an image displayed on the screen during the aforementioned processing flow, and FIGS. 31(*a*) through 31(*f*) are examples respectively showing the sight moving, sight stopping, sight having moved to the edge of the screen, screen scrolling, screen scrolling, and sight unable to move.
Figure 31B:
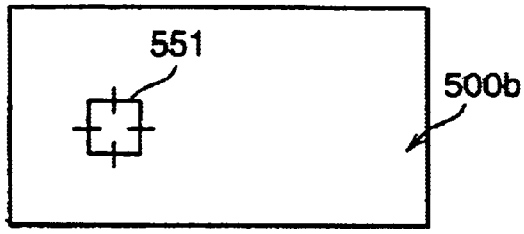
Figure 31C:
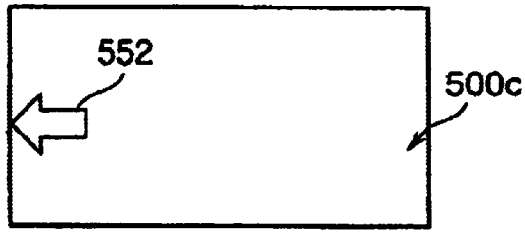
Figure 31D:
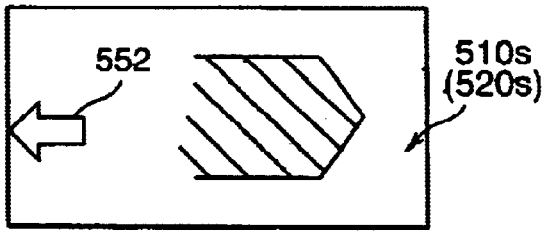
Figure 31E:
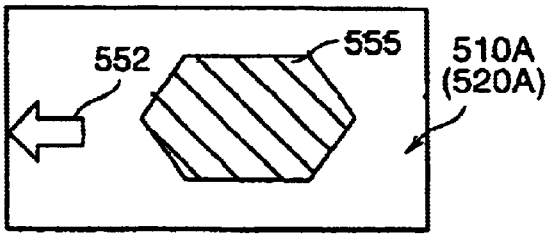
Figure 31F:
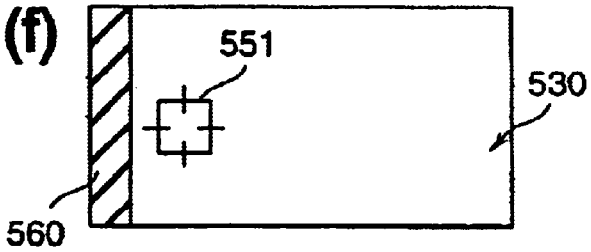
Figure 32:
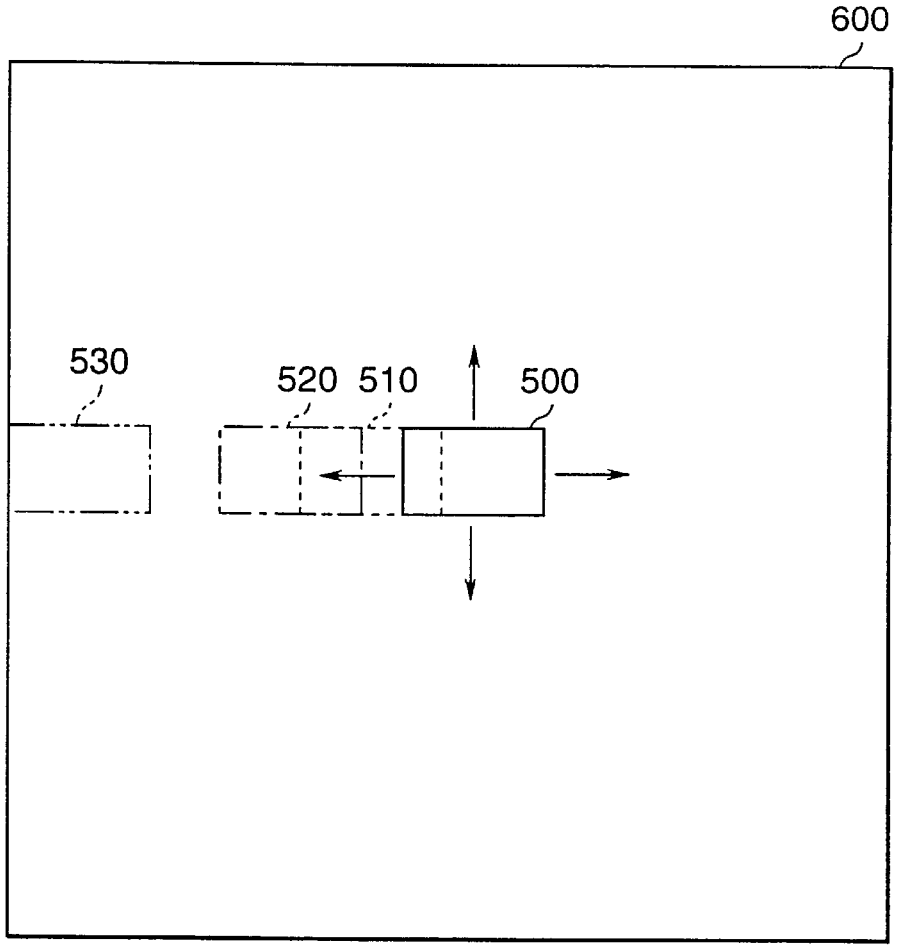
FIG. 32 is a typical diagram showing the relationship between the position of the image memory storing the image data and the screen displaying the current picture in the present embodiment.

This controller 35*a* is similarly connected to the game processing board not shown and is used as follows to progress the game. Here, FIG. 30 is the flowchart showing the processing flow upon the aforementioned movement. FIGS. 31(*a*), 31(*b*), 31(*c*), 31(*d*), 31(*e*) and 31(*f*) are diagrams showing an image example displayed on the screen during the course of the aforementioned processing flow. FIGS. 31(*a*) through 31(*f*) are examples respectively showing the sight moving, sight stopping, sight having moved to the edge of the screen, screen scrolling, screen scrolling, and sight unable to move. FIG. 32 is a typical diagram showing the relationship between the position of the image memory storing the image data and the picture currently shown on the screen.

When the trigger lever 47 of the gun-shaped controller 35 is pulled, instruction signals from the trigger switch 98 are input to the signal processing circuit 53. These signals are provided from the signal processing circuit 53 to the CPU 301 via the I/O interface 306. Thereby, unlocking signals from the CPU 301 are provided to the driving circuit 152 via the I/O interface 306. These unlocking signals are provided from the driving circuit to the solenoid 92, and the solenoid 92 moves the link 91 in the horizontal direction as shown with the arrow in FIG. 23(*c*). The guide roller 88 on the tip of the latch 87 then disengages from the groove 86 of the operation button 37, and the operation button is biased by the coil spring 83 and moves in the horizontal direction shown with the arrow in FIG. 23(*c*). The operation button 37, in the end, becomes as shown in FIG. 23(*a*). FIG. 23(*c*) shows the moment the guide roller 88 on the tip of the latch 87 is removed from the groove 86 of the operation button 37. Although the aforementioned explanation is related to the operation of the operation button 37, the operation is the same for operation buttons 38, 39.

Figure 24:
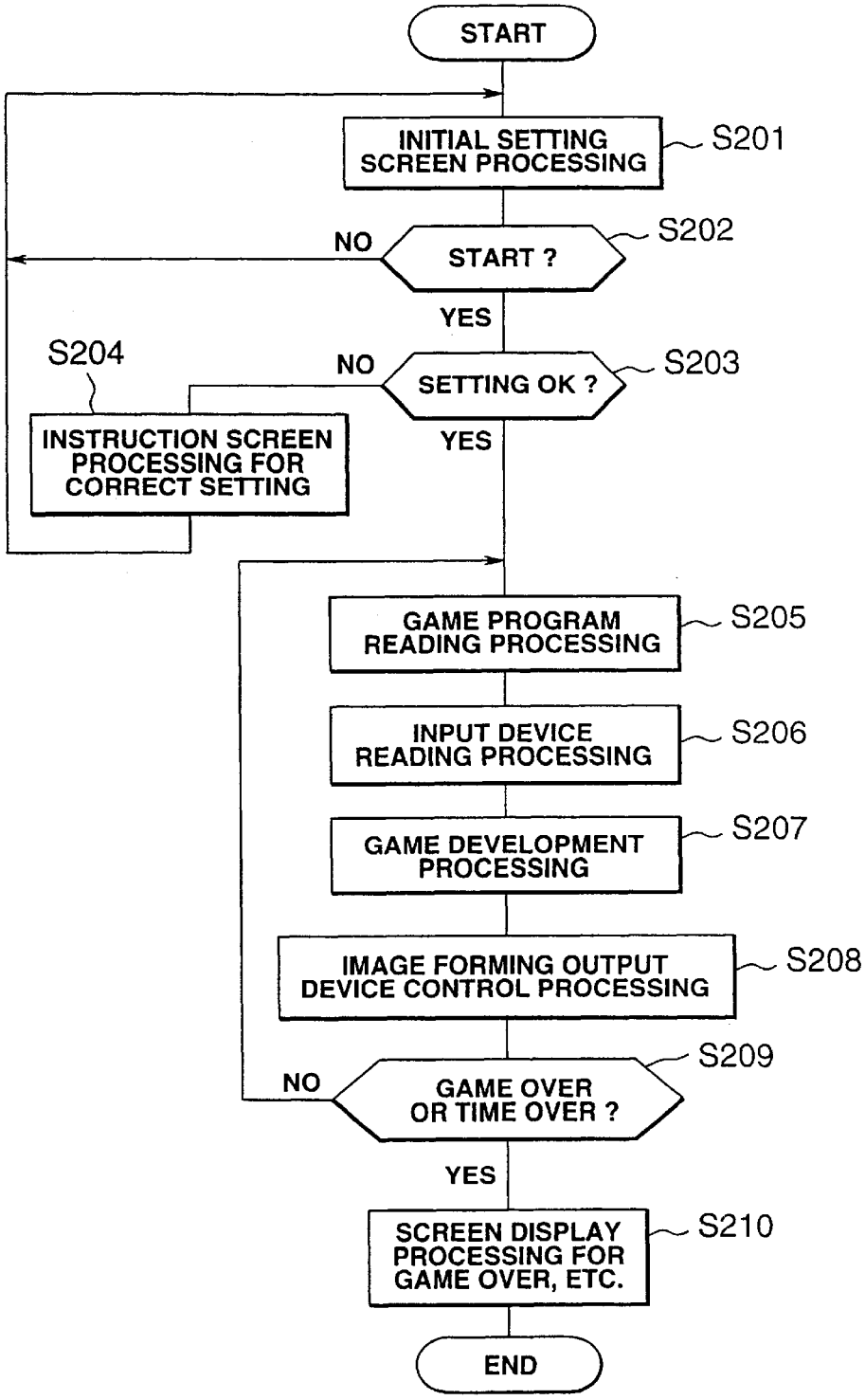
FIG. 24 is a flowchart explaining the main processing of the game device.

FIG. 24 is a flowchart for explaining the main processing of the game device. In this FIG. 24, the CPU 301 of the game processing board 30 performs the game processing as follows.

Foremost, the game processing board 30 forms the initial setup screen under the control of the CPU 301, and provides this to the monitor 31. In this initial screen, set is necessary information for progressing the game such as the strength of the main character and the like (S201).

Next, the CPU 301 of the game processing board 30 judges whether or not the start button (not shown) has been operated (S202). If the start button has not been operated (S202; NO), it returns once again to the initial screen processing.

When the start button has been operated (S202; YES), the CPU 301 judges whether proper setting is made (S203). If not (S203; NO), the game processing board 30 forms display information for proper setting and provides this to the monitor 31, and returns once again to the initial screen processing.

If the CPU judges that proper setting is made (S204; YES), the game is started. That is, the CPU 301 foremost reads the game program (S205) and reads each element of the input device 95 (S206). The CPU 301 then develops the game pursuant to the information from the game program and the input device 95 and provides necessary orders for developing the game to the coprocessor 308, geometrizer 310, operation device 307, etc (S207). Pursuant thereto, the image generating system (scroll data operation device 307, coprocessor 308, . . . , D/A converter 317) on the game processing board 30, forms image signals based on the game development and provides this to the monitor 31 (S208). Similarly, the sound generating system (sound device 304, electric amplifier circuit 305) on the game processing board generates and amplifies sound pursuant to the game development and provides this to the speakers 32, 32 (S208). Similarly, the CPU 301 on the game processing board drives the recoil mechanism 52 via the I/O interface 306, lights up/turns off the indicators 41, 42, 43, and excites the solenoids 92*a*, 92*b*, 92*c* of the unlocking mechanism 77 (S208).

The CPU 301 thereafter judges whether it is game over or time over (S209). If not over (S209; NO), it returns to the reading processing of the game program (S205) and continues the following processing steps.

Unless it is game over or time over, the game processing board 30 continues the processing steps of S205 to S209 above.

If the game processing board 30 judges that it is game over or time over (S209; YES), the game processing board 30 forms a game over or time over screen and provides this to the monitor 31 (S210)

Various processing steps are performed as above.

By the CPU 301 performing the aforementioned processing steps S205 to S209, the image processing means is realized. The image processing means forms images of the main character successively moving along a predetermined course. While the main character moves along such predetermined course, enemy characters appear, and the main character moving under the control of the gun-shaped controller 35 and these enemy characters battle each other with bazookas.

Figure 25:
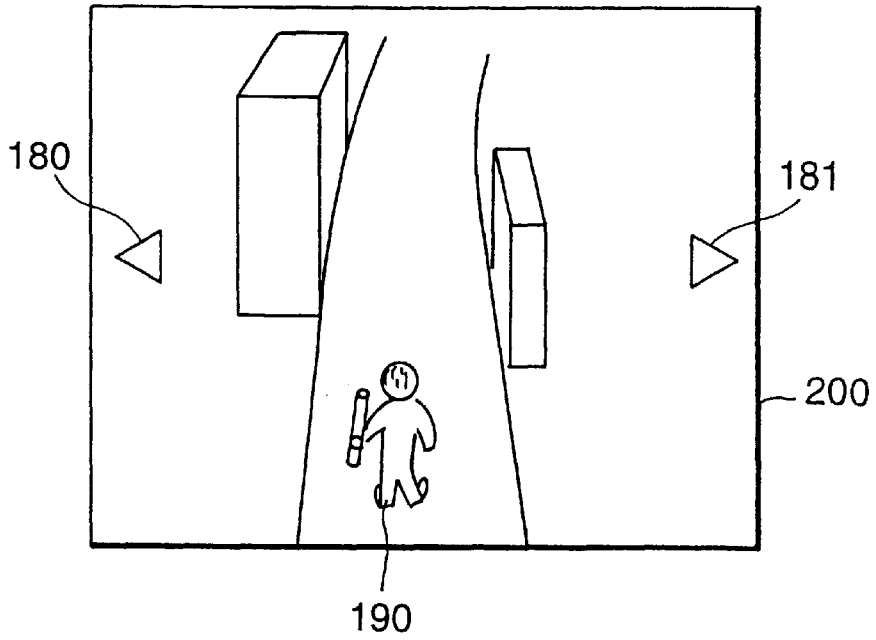
FIG. 25 is a diagram showing an example of an image generated by the game device.

Furthermore, by the CPU 301 performing the aforementioned processing steps S205 to S209, the realized image processing means forms the game image 200 from an objective viewpoint in which the main character can be seen as shown in FIG. 25 when it is provided with instruction signals for moving the main character upon the directional key 49 or 50 of the gun-shaped controller 35 being operated. The image processing means forms image signals so as to display arrows (cursors) 180, 181 on the left and right sides of the screen 200. These arrows (cursors) 180, 181 show the operational state of the directional keys 49, 50 of the gun-shaped controller 35, that is, the moving direction of the main character 170. The image processing means further changes the color of the arrows (cursors) 180, 181 in accordance with instruction signals and the development of the game. The image processing means thereby forms image signals capable of displaying the movement direction of the main character and the outline of the situation of the main character (e.g., whether it is in an attackable condition) by the combination of the colors of these arrows (cursors) 180, 181.

Figure 26:
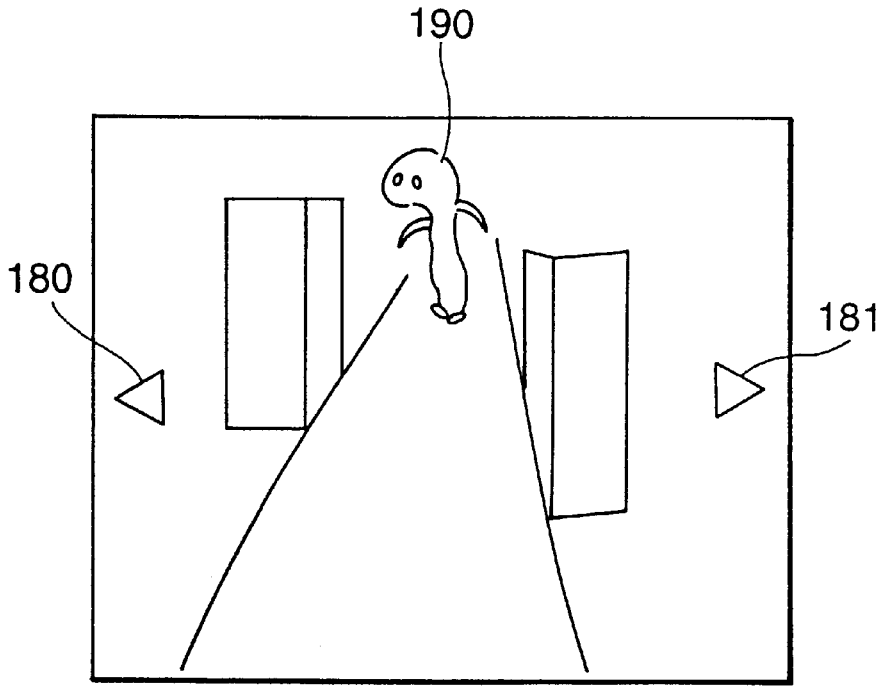
FIG. 26 is a diagram showing another example of an image generated by the game device.

Contrarily, the image processing means realized by the CPU 301 performing the aforementioned processing steps S205 to S209 forms an image 201 from the main character's viewpoint shown in FIG. 26 when battling an enemy character. In other words, as the image processing means forms an image 201 wherein the main character is viewing such picture, the main character is not displayed within the image 201 as a matter of course.

Furthermore, the image processing means realized by the CPU 301 performing the aforementioned processing steps S205 to S209 determines the attacking power, destruction power, impact distance of the cannonball in accordance with the operational patterns of the plurality of operation buttons 37, 38, 39 of the virtual bullet-loading portion 75, and progresses the game in accordance therewith.

For example, if only the blue operation button 37 is pushed and locked, the game processing means progresses the game as follows as though a small rocket launcher has been loaded. Further, if the blue operation button 37 is pushed and locked and then the yellow operation button 38 is pushed and locked, the game processing means progresses the game as follows as though a medium rocket has been loaded. Moreover, if the blue operation button 37 is pushed and locked, the yellow operation button 38 is pushed and locked thereafter, and then the red operation button 39 is finally pushed and locked, the game processing means progresses the game as though a large rocket has been loaded. If the blue operation button 37 is pushed and locked and then the red operation button 39 is pushed and locked, the game processing means progresses the game as though a small grenade has been loaded. Other combinations are also possible, but the essential point is that the game processing means determines the attacking power, destruction power and impact distance of the cannonball pursuant to the push-lock order of the operation buttons 37, 38, 39 and progresses the game in accordance therewith.

Figure 27:
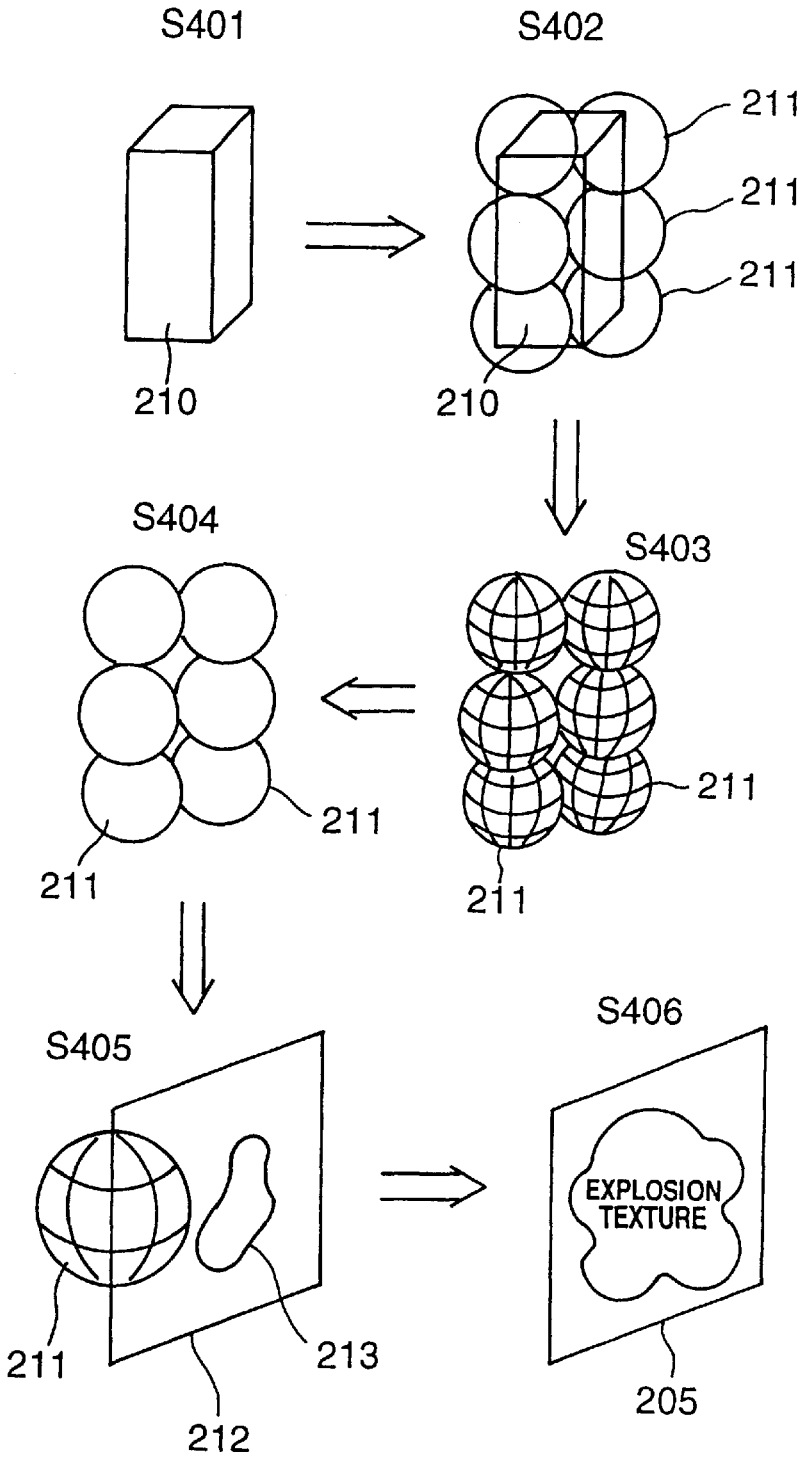
FIG. 27 is a diagram explaining the processing of an explosion picture according to the present embodiment.

FIG. 27 is a diagram for explaining the processing of explosion pictures. The image processing means realized by the CPU 301 performing the aforementioned processing steps of S205 to S209 performs the processing steps as follows.

The CPU 301 of the game processing board 30 instantaneously makes the screen of the monitor 31 bright when the trigger lever 47 of the gun-shaped controller 35 is pulled. The light detecting means of the gun-shaped controller detects this light and provides the light detection signals to the CPU 301 via the signal processing circuit 53 and I/O interface 306. The CPU 301 determines the impact position based on these light detection signals.

If the impact position is the building 210 within the screen (S410), for example, the image processing means produces a semitransparent explosion picture with three-dimensional (3D) polygons 211 and erases the building 210 (S402). The image processing means then compulsorily makes semitransparent and erases the explosion picture made of 3D polygons 211 after a predetermined time (S403, S404). At such time, during S254, the outline of the 3D polygons 211 is extremely unnatural and conspicuous. Thus, an image 205 is formed (S405) wherein a naturally disappearing texture 213 is applied to the plane polygon 212 and layered on to the front of the 3D polygons 211. In other words, by the image processing means performing the aforementioned processing steps of S401 to S406, it successively forms explosion images generated with 3D polygons 211 showing the course of the cannonball impacting, exploding, and disappearing in accordance with the lapse of time, and applies, to the plane polygon 212 placed in front of the explosion pictures of 3D polygons 211 showing the course of disappearance, two-dimensional explosion images similarly showing the course of disappearance as a semitransparent texture 213.

Figure 28:
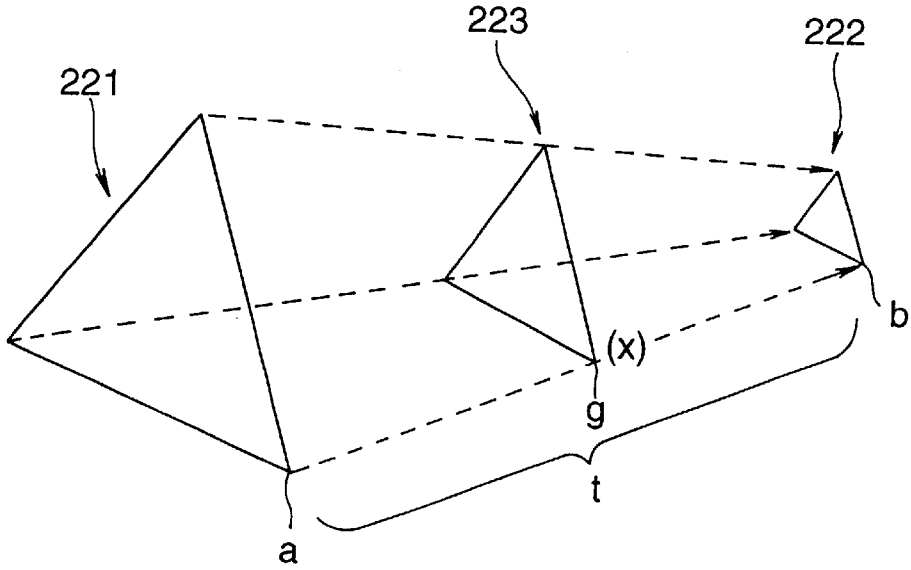
FIG. 28 is a diagram explaining the interpolation processing of image generation according to the present embodiment.

FIG. 28 is a diagram for explaining the interpolation processing of image generation. The image processing means realized by the CPU 301 performing the aforementioned processing steps of S205 to S209, when performing modifying processing to characters as a result of a cannonball explosion and the like, determines the polygon 221 position of the character before modification and the polygon 222 position of the character after modification, and performs interpolation processing of modifying the polygons 223 therebetween based on polygon position information of both characters.

Specifically, the image processing means calculates coordinate x of the vertex of the polygon to be interpolated from the beginning of modification to the completion thereof with the formula of:

$$x=a+(b-a)\times(g/t)$$

wherein a is the coordinate of the vertex of the polygon before modification, b is the coordinate of the vertex of the polygon after modification, t is the total number of steps until completion of modification, and g is the current number of steps.

By this, image processing is enabled without having to prepare numerous modification images.

Figure 29:
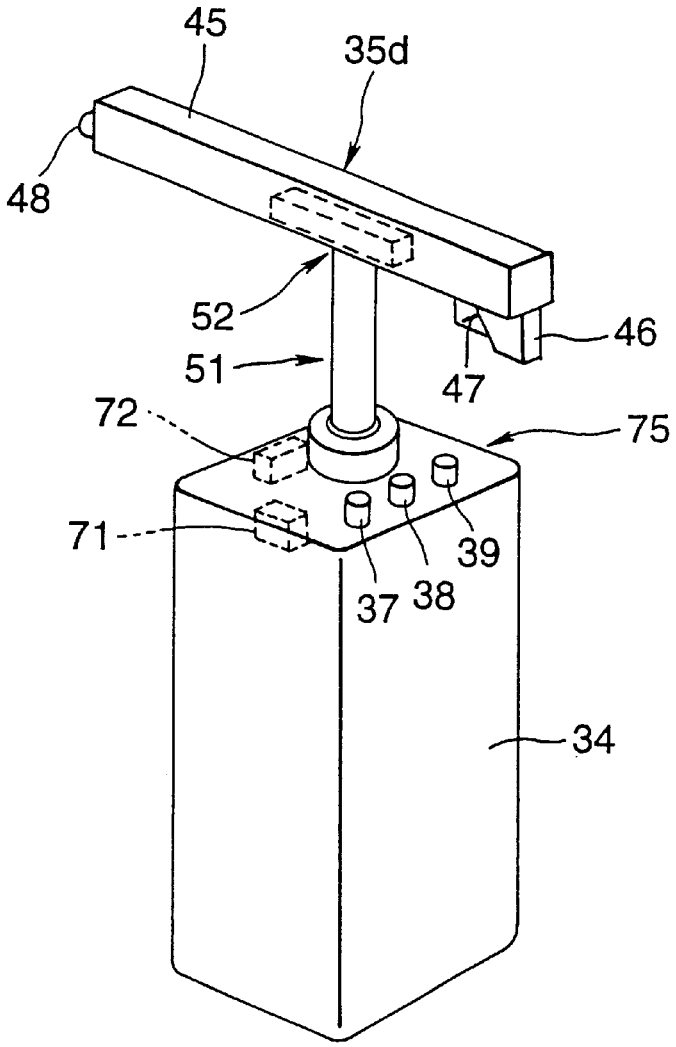
FIG. 29 is a perspective diagram showing a structural example of another gun-shaped controller according to the present embodiment.

FIG. 29 is a perspective diagram showing another structure of the gun-shaped controller. The difference between the gun-shaped controller 35*a* shown in this FIG. 29 and the gun-shaped controller 35 in Embodiment 6 is that the directional keys 49, 50 provided to the gun-shaped controller 35 in Embodiment 6 have been removed. As the other structural components are the same, the explanation thereof is omitted.

This controller 35*a* is similarly connected to the game processing board not shown and is used as follows to progress the game. Here, FIG. 30 is the flowchart showing the processing flow upon the aforementioned movement. FIG. 31 is a diagram showing an image example displayed on the screen during the course of the aforementioned processing flow. FIGS. 31(*a*) through 31(*f*) are examples respectively showing the sight moving, sight stopping, sight having moved to the edge of the screen, screen scrolling, screen scrolling, and sight unable to move. FIG. 32 is a typical diagram showing the relationship between the position of the image memory storing the image data and the picture currently shown on the screen.

The CPU 301 of the game processing board 30 (refer to FIG. 20) reads detection signals (vertical direction on the screen (up and down the screen)) from the sensor 71 and the detection signals (left and right of the screen) from the sensor 72 of the gun-shaped controller 35*a* and moves the instruction indicator (sight: here, "sight" shall mean the telescopic sight of the gun-shaped controller 35*a* displayed on the screen 500) 551 displayed on the screen 500 in the up, down, right, and left directions thereof. And when the sight 551 moves to the edge of the screen 500, the CPU 301 realizes the image processing means for controlling the movement direction. In other words, the image processing means displays the moving direction indicator 552 (e.g., the arrow shown in FIG. 31(*c*)) and moves the main character a prescribed distance for each prescribed time frame.

For example, if the gun-shaped controller 35*a* is directed to the left side of the screen 500*a*, the sensor 72 detects this, and the detection signals are input to the CPU 301. Thereby, the CPU 301 moves the sight 551 within the screen 500*a* to the left side of the screen as shown in FIG. 31(*a*).

Moreover, if the gun-shaped controller 35*a* is maintained at a certain position after being directed to the left side of the screen 500*a*, detection signals of movement from the sensor 72 are no longer detected, and the CPU 301 displays the sight 551 within the screen 500*b* as being still as shown in FIG. 31 (*b*)

If the gun-shaped controller is further directed to the left side, the CPU 301 reads signals from the sensor 72 and moves the sight 551 within the screen 500 further to the left. Here, the CPU 301 displays the image data within a prescribed area (area shown in solid lines with reference numeral 500) in the image memory 600 shown in FIG. 32 on the monitor 31 (refer to FIGS. 12 and 20) as the image 500.

Here, when the sight 551 reaches the edge of the screen 500 (the left side in this case), the CPU 301 realizes the image processing means and the flowchart shown in FIG. 30 is performed by this image processing means (S400).

When the sight 551 reaches the edge of the screen 500 (S400), the image processing means foremost performs the processing for displaying an arrow (movement direction indicator) in place of the sight (S401). Thereby, an arrow 552 is displayed on the screen 500*c* as shown in FIG. 31(*c*).

Next, the image processing means judges whether a prescribed time frame (approx. 2 seconds for example) has elapsed (S402).

If the image processing means judges that a prescribed time frame (approx. 2 seconds for example) has not elapsed (S402; NO), it returns to the processing of displaying the arrow (movement direction indicator) and performs once again arrow displaying processing (S401). Here, shown on the monitor 31 (refer to FIGS. 12 and 20) is the screen 500*c* displaying the arrow 552 at the left edge of the screen as shown in FIG. 31(*c*). Furthermore, the image processing means displays the image data of the area (area shown in solid lines in reference numeral 500) of the image memory 600 as the image 500*c*.

If the image processing means judges that a prescribed time frame (approx. 2 seconds for example) has elapsed (S402; YES), the image processing means performs scroll processing (S404). Thereby, the arrow 552 shown in FIG. 31(*d*) remains displayed on the monitor 31 and a scroll screen 510*s*, in which a display picture 555 is beginning to appear, is displayed on the monitor 31. Here, the image processing means displays the image data of the area (area shown with solid lines in reference numeral 510) within the image memory 600 as images 510*s*, 510A. The image 510*s* shown in FIG. 31(*d*) represents an image at the beginning of the scroll and the image 510A shown in FIG. 31(*e*) represents an image upon the completion of the scroll.

The image processing means then judges whether the sight has moved to the edge of the image memory 600 (S404). This judges whether the sight has reached the top/bottom edge or right/left edge of the image memory 600. Here, as the arrow 552 is facing the left side, the image processing means judges whether the sight has reached the left edge area (area shown with solid lines in reference numeral 530) of the image memory 600 as shown in FIG. 32 (S404).

In this case, as the sight is still in the area (area shown with two-point chained lines in reference numeral 510) in the vicinity of the center of the image memory 600, the image processing means judges that the sight is within a prescribed range (S404; YES), forms images in the area (area shown with two-point chained lines) in the vicinity of the center of the image memory 600 and displays this as the image 510A. The image processing means then returns to the initial arrow displaying processing (S401).

Once again, the image processing means judges whether a prescribed time frame (approx. 2 seconds for example) has elapsed (S402). If the image processing means judges that a prescribed time frame (approx. 2 seconds for example) has not elapsed (S402; NO), it returns to the processing of displaying the arrow (movement direction indicator) and performs once again arrow displaying processing (S401). Here, shown on the monitor 31 (refer to FIGS. 12 and 20) is the screen S10A displaying the arrow 552 at the left edge of the screen as shown in FIG. 31(*e*). Furthermore, the image processing means displays the image data of the area (area shown in solid lines in reference numeral 510) of the image memory 600 as the image 510A.

If the image processing means judges that a prescribed time frame (approx. 2 seconds for example) has elapsed (S402; YES), the image processing means performs scroll processing (S404). Thereby, the arrow 552 shown in FIG. 31(*d*) remains displayed on the monitor 31 and a scroll screen 510*s*, in which a display picture 555 is beginning to appear, is displayed on the monitor 31. Here, the image processing means displays the image data of the area (area shown with solid lines in reference numeral 520*s*) within the image memory 600 as images 520*s*, 520A. The image 510*s* shown in FIG. 31(*e*) represents an image at the beginning of the scroll and the image 510A shown in FIG. 31(*e*) represents an image upon the completion of the scroll.

The image processing means then judges whether the sight has moved to the edge of the image memory 600 (S404). This judges whether the sight has reached the top/bottom edge or right/left edge of the image memory 600. Here, as the arrow 552 is facing the left side, the image processing means judges whether the sight has reached the left edge area (area shown with solid lines in reference numeral 530) of the image memory 600 as shown in FIG. 32 (S404).

In this case, as the sight is still in the area (area shown with two-point chained lines in reference numeral 520) in the vicinity of the center of the image memory 600, the image processing means judges that the sight is within a prescribed range (S404; YES), forms images in the area (area shown with two-point chained lines in reference numeral 530) in the vicinity of the center of the image memory 600 and displays this as the image 520A. The image processing means then returns to the initial arrow displaying processing (S401).

Like this, the image scrolls for each prescribed time frame (2 seconds for example) and the main character is displayed each such occasion as though it moved a prescribed distance (3 meters for example) within the images 500, 510, 520.

Therefore, by moving the gun-shaped controller up, down, left, and right within the screen, the image processing means displays the main character as though it moved a prescribed distance within the screen.

The image processing means once again judges whether the sight moved to the edge of the image memory 600 per scroll processing (S404). That is, as the arrow 525 is facing the left side, the image processing means judges whether the sight has reached the left edge area (area shown with the two-point chain line in reference numeral 530) of the image memory 600 as shown in FIG. 32 (S404) . Upon the image processing means performing scroll processing for each prescribed time frame, when the sight finally reaches the left edge area (area shown with the two-point chain line in reference numeral 530) of the image memory 600 (S404; NO), the image processing means performs the immovable display processing (S405).

When the image processing means performs the immovable display processing (S405), an image 530 as shown in FIG. 31(*f*) is displayed on the monitor 31. In other words, the image 530 shown in FIG. 31(*f*) is displayed in a stripe 560 with overall left edge being a fixed color ("yellow" and "black" for example), and a sight 551 is displayed in place of the arrow 552.

As mentioned above, by conducting specific operations with the gun-shaped controller for moving the main character, an arrow is displayed at the left edge of the monitor 31. By a prescribed time frame lapsing in such display state, it is possible to move the main character a prescribed distance.

Figure 33:
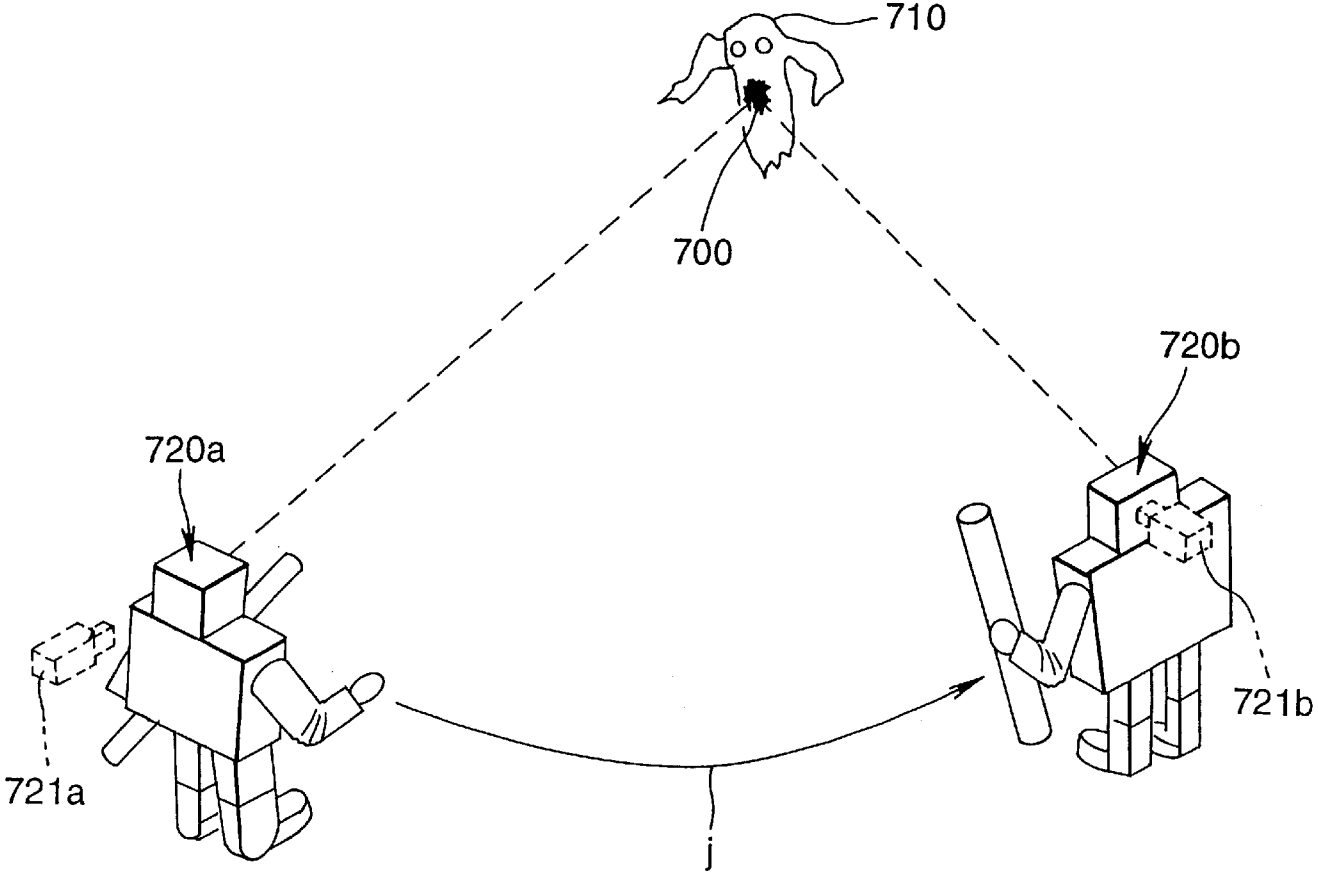
FIG. 33 is a diagram for explaining the relationship between the movement of the main character and the viewing point.
Figure 34B:
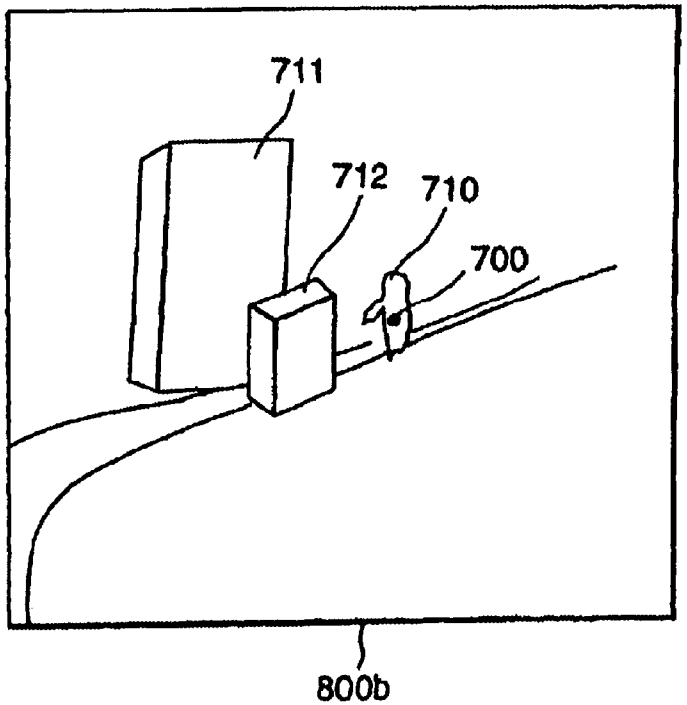
FIGS. 34(*a*) and 34(*b*) are diagrams explaining the situation where the relationship between the movement of the main character and the viewing point are displayed on the screen.
Figure 34A:
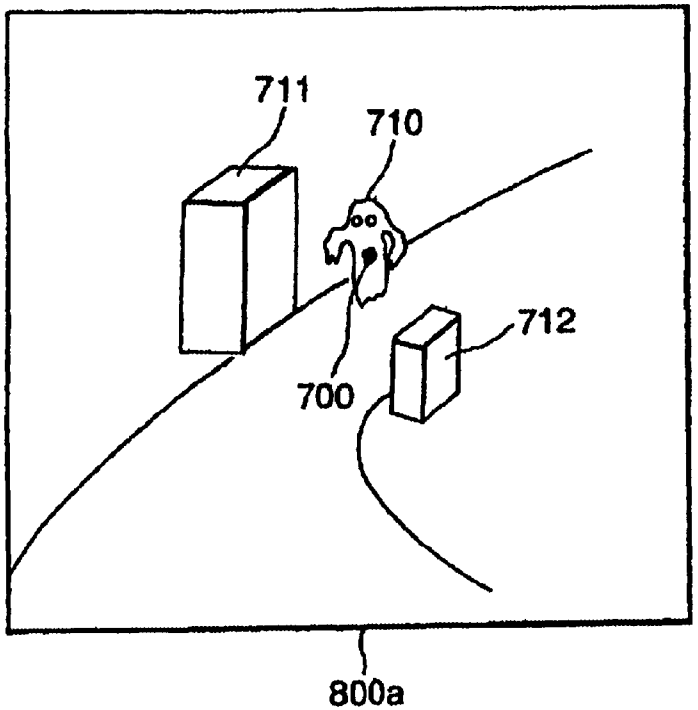

FIG. 33 is a diagram for explaining the relationship of the movement of the main character and the viewing point. FIG. 34 is a diagram explaining the situation where the relationship between the movement of the main character and the viewing point are displayed on the screen.

As mentioned above, it is possible to move the character a prescribed distance after an arrow is displayed on the screen for a prescribed period of time. Explained below is the relationship between the main character's viewpoint at such time and the movement of the character.

In FIG. 33, reference numeral 700 is the viewing point of the main character 720. This viewing point 700 is for example the enemy character 710. As the viewpoint viewed from the eyes of the main character 720 (in this case, "subjective viewpoint"), the virtual camera 721 reads images of its periphery, including the enemy character, as image data.

Supposing that the main character 720*a* is at a certain point, the main character 720*a* is viewing the viewing point 700. As a state filmed by the virtual camera 721*a,* displayed on the monitor 31 is an image 800*a* as shown in FIG. 34(*a*). In this image 800*a,* for example, displayed are an enemy character 710 and buildings 711, 712 as shown in FIG. 34(*a*).

Let it be assumed that the main character 720 has moved a prescribed distance for each prescribed time frame elapsed. For example, if the main character 720*a* moves along arrow j as shown in FIG. 33 and it is necessary to display an image seen from the main character 720*a,* the virtual cameral 721*b,* without losing the viewing point 700, reads other images and displays such images on the monitor 31. Therefore, an image 800*b* as shown in FIG. 34(*b*) is displayed on the monitor 31. Even in such case, the viewing point 700 does not change. Furthermore, as shown in FIG. 34(*b*), an enemy character 710, viewing point 700, and buildings 711, 712 are displayed in the image 800*b*.

Even though the main character 720 moves, the viewing point 700 which the main character is observing does not change, and other images are changed and displayed.

Although this explanation is directed to forming images from the subjective viewpoint of the main character 720, it is not limited thereto. The viewing point 700 is always displayed without being changed in the objective viewpoint as well (here, "objective viewpoint" is not the viewpoint viewed by the main character, but an objective viewpoint in which the head or body of the main character may be viewed).

In the aforementioned embodiment, for judging the impact point, the screen of the monitor is instantaneously brightened the moment the trigger is pulled, and the position within the screen of the monitor 31 is specified with the light detection means 48 of the gun-shaped controller 35, 35*a*. It is not, however, limited thereto. The position of the screen of the monitor 31 may be specified with the detection signals from the sensors 71, 72 of the gun-shaped controller 35, 35*a,* and the impact position may be determined pursuant to this specified data.

The spirit of the invention described in the present application may be applied to, other than a gun-shaped controller, various controllers to be held such as a steering wheel-shaped controller for vehicle race games, a control lever-shaped controller for flight games, a fishing pole-shaped controller for fishing games, and so on. In other words, the present invention may be applied to various controllers in which the change of the controller's position, such as the direction of the muzzle, rotation of the handle, inclination/pull/push of the control lever, and inclination of the fishing pole, with respect to a standard such as the display screen of an electronic amusement device or game machine, is supplied to the data processing means of the electronic amusement device as the controlled variable, and which is held by a player substantially throughout the game play. The direction signal output means provided to this controller is capable of controlling the motion direction and movement direction of the displayed objects such as characters and backgrounds appearing in the game screen. The player may, for example, perform the game processing of operating the gun-shaped controller and firing virtual bullets used in the game toward the game screen.

INDUSTRIAL APPLICABILITY

As mentioned above, according to the gun-shaped controller of the present invention, by forming a cross-shaped directional key 9, which is used as an operation key to be manually operated by an operator, integrally with the gun-shaped controller, enabled are complex movements such as moving the character on the screen or the character's visual field with this cross-shaped directional key in addition to the conventional action of shooting the targets on the screen. Thus, the gun-shaped controller is compatible with roll-playing games and adventure games. Moreover, provided is a gun-shaped controller capable of increasing the variation of the game software to be used and performing highly amusing games.

Furthermore, according to the game device of the present invention, provided is a game development with enhanced amusement by employing the gun-shaped controller, and a virtual sensation may be experienced in accordance with the situation within such game development.

What is claimed is:

1. A gun-shaped controller for use with an electronic game device which controls a game development in response to signals supplied from the controller, said gun-shaped controller comprising:

a gun barrel;

a grip to be held by the player;

a trigger lever provided at a portion of the gun-shaped controller manually operable by an index finger of a hand holding the gun-shaped controller at the grip;

light sensor means provided at a front portion of said gun barrel to detect signals indicative of positions on a display screen; and a directional key provided at a rear portion of said gun-shaped controller manually operable by a thumb of the hand holding the gun-shaped controller at the grip to supply the game device with signals indicative of directions, wherein an object displayed on the display screen moves in response to the signals indicative of directions under control of the game device.

2. A gun-shaped controller according to claim 1, further comprising a display provided at a rear portion of the gun-shaped controller.

3. A gun-shaped controller for an electronic amusement device, wherein said controller supplies to said electronic amusement device a controlled variable which is a variation in a position of the controller itself while said controller is to be held and operated by a player during a game play, the controller comprising:

a gun barrel;

a grip to be held by the player;

a trigger lever to be operated by the player;

signal supplying means including a directional key which supplies signals indicative of directions to said amusement device, wherein said directional key is manually operable by the player, and an object displayed on a screen of a display means under control of said amusement device moves in at least one of a plurality of directions in response to said signals; and light detecting means provided at a front portion of said gun barrel, which detects a signal indicative of a position on said screen.

4. A controller according to claim 3, wherein said directional key is arranged in a vicinity of a tip of said gun barrel.

5. A gun-shaped controller according to claim 3, wherein said signals pertain to a game development with respect to a game image displayed on the screen of said display means and said directional key is integrally formed with said gun barrel.

6. A gun-shaped controller according to claim 3, wherein said plurality of directions comprise movements of upward, downward, leftward, and rightward.

7. A gun-shaped controller according to claim 3, wherein said displayed object is a character or cursor displayed on said screen.

8. A gun-shaped controller according to claim 3, wherein said directional key is arranged on an upper part of said grip.

9. A gun-shaped controller according to claim 3, wherein said gun-shaped controller has a contact sensor for detecting a contact state between the player and the contact sensor and a virtual bullet-loading portion, which includes the contact sensor, for loading bullets virtually based on the contact state between the player and said contact sensor.

10. A gun-shaped controller according to claim 9, wherein said virtual bullet-loading portion is provided at a bottom portion of said grip and further comprises a sensor holder for movably mounting said contact sensor on the bottom portion of said grip.

11. A gun-shaped controller according to claim 3, wherein said gun-shaped controller has a reload lever provided on a side of said gun barrel and arranged so as to be slidable on the side of said gun barrel, and a virtual bullet-loading portion for virtually loading bullets with operation of said reload lever.

12. A gun-shaped controller according to claim 3, wherein said gun-shaped controller is provided with a mounting portion for mounting a memory device.

13. A gun-shaped controller according to claim 12, wherein said memory device is provided with a display screen for displaying information.

14. A gun-shaped controller according to claim 12 or 13, wherein said mounting portion is provided to a tail protruding to a rear from said grip.

15. A gun-shaped controller according to any one of claims 8 and 9 through 13, wherein a cable is provided to a rear end of said grip.

16. A gun-shaped controller according to claim 14, wherein a cable is provided to a rear end of said tail.

17. A gun-shaped controller according to claim 3, wherein said gun-shaped controller is provided with a display screen for displaying information.

18. A gun-shaped controller according to claim 3 wherein a lower face of said gun barrel is formed diagonally with respect to a lengthwise axis of the gun barrel from the lower face of a vicinity of a tip of said gun barrel to a portion to be connected with said trigger, and said directional key for instructing directions is provided at an upper part of said grip.

19. A gun-shaped controller according to claim 18, wherein an operation button is provided to an upper part of said directional key.

20. A gun-shaped controller according to claim 18 or 19, wherein said directional key is arranged on a face formed continuously to a rear face of said grip and inclined toward the tip of the gun barrel rather than the rear face.

21. A gun-shaped controller according to claim 18 or 19, wherein said directional key is positioned higher than, at least, a tip of said trigger lever when the lengthwise axis of said gun barrel is to be a horizontal standard.

22. A gun-shaped controller according to claim 18 or 19, wherein said directional key is positioned approximately in a center of a widthwise direction of the gun when viewed from a rear position of the gun.

23. A gun-shaped controller according to claim 19, wherein a mounting portion for mounting a peripheral is formed in the lengthwise axis direction of the gun barrel at a rear of said gun barrel and positioned at the upper part of said directional key.

24. A gun-shaped controller according to claim 22, wherein said peripheral is a memory device comprising a display screen for displaying information.

25. A gun-shaped controller according to claim 18 or 19, wherein said trigger lever is provided to a position which can be operated with a thumb of a hand of the operator holding said grip.

26. A gun-shaped controller according to claim 3, wherein the player is able to conduct an operation of virtually firing a cannonball toward a game image displayed on the screen of said display means, and wherein said gun-shaped controller further comprises a recoil mechanism for providing recoil to said gun barrel when said cannonball is fired.

27. A gun-shaped controller according to claim 3, wherein said amusement device forms game images in a style wherein an enemy character and a main character shown within the screen displayed on said display means battle each other, said signals provide instructing directions to a game machine of said amusement device for moving the main character on said screen and for attacking the enemy character on the screen, and said game machine processes a predetermined game program, moves the main character pursuant to the signals from said gun-shaped controller, and progresses and develops the game.

28. A gun-shaped controller according to claim 27, wherein said game machine comprises image processing means for forming images of the main character successively moving along a predetermined course.

29. A gun-shaped controller according to claim 27, wherein said game machine comprises image processing means for forming game images from an objective viewpoint to view the main character when provided with signals from said gun-shaped controller for moving the main character, and an image from the main character's viewpoint when fighting with the enemy character.

30. A gun-shaped controller according to claim 27, wherein said directional key is provided at an upper part of said gun barrel for instructing the main character to move left or right, and said gun-shaped controller further comprises:

signal processing means for transmitting said signals for instructing directions according to an operation of the trigger lever and transmitting the light detection signals received from said light detecting means;

supporting mechanism for rotatably supporting said gun barrel on a pedestal; and a recoil mechanism for providing recoil to the gun barrel when a cannonball is fired.

31. A gun-shaped controller according to claim 30, wherein said recoil mechanism comprises:

a movable mechanism for supporting the gun barrel and supporting mechanism reciprocally and biasing said gun barrel in one direction with an elastic member;

a rotation/reciprocation converter mechanism for supplying reciprocation to said movable mechanism; and a driving source for rotatably driving said rotation/reciprocation converter mechanism.

32. A gun-shaped controller according to claim 27, wherein a plurality of operation buttons enabling a push operation of predetermined strokes at a rear of the gun barrel are arranged on an upper part of the pedestal supporting the gun barrel of said gun-shaped controller, and wherein said game machine comprises game processing means for determining an attacking power, destruction power and impact distance of a fired cannonball in accordance with the operation pattern of the plurality of operation buttons on a virtual bullet-loading portion, and progresses the game in accordance with such determination.

33. A gun-shaped controller according to claim 32, wherein said virtual bullet-loading portion comprises:

an operation button, to which a push operation of predetermined strokes is enabled, for transmitting operation signals of such push operation;

a locking mechanism for locking said operation button when said operation button is pushed a prescribed number of strokes; and an unlocking mechanism for unlocking said operation button when a cannonball is fired by the operation of said trigger lever.

34. A gun-shaped controller according to claim 27, wherein said game machine successively forms three-dimensional explosion images of a course of a cannonball impacting, exploding, and disappearing in accordance with a lapse of time, and comprises image processing means for applying, to the three-dimensional explosion images showing the course of disappearance, two-dimensional explosion images similarly showing the course of disappearance as a semitransparent texture.

35. A gun-shaped controller according to claim 27, wherein said game machine comprises image processing means which, when performing modifying processing to a character as a result of a cannonball explosion, determines a first polygon position of the character before modification and a second polygon position of the character after modification, and performs interpolation processing of modifying a polygon therebetween based on the first and second polygon positions.

36. A gun-shaped controller according to claim 35, wherein said image processing means calculates coordinate x of a vertex of the polygon to be interpolated from the first polygon position to the second polygon position with the formula of:

$$x=a+(b-a)\times(g/t)$$

wherein a is the coordinate of a vertex of the polygon at the first polygon position, b is the coordinate of a vertex of the polygon at the second polygon position, t is a total number of steps until completion of modification, and g is a current number of steps.

37. A gun-shaped controller according to claim 27, wherein said gun-shaped controller is rotatably secured to a pedestal arranged in front of display means of a housing containing said game machine and display means via a supporting mechanism.

38. A gun-shaped controller according to claim 27, 35 or 36, wherein said gun-shaped controller is structured of a shape imitating a bazooka.

39. A gun-shaped controller according to claim 33, wherein the plurality of operation buttons provided at the pedestal supporting the gun barrel of said gun-shaped controller have a same color as indicators on an upper part of a housing containing said game machine and display means and are provided in a same arrangement as said indicators, wherein one of the indicators corresponding to an operation button of the plurality of operation buttons lights up when said operation button is pushed a predetermined number of strokes and locked by the locking mechanism, and the indicator corresponding to said operation button turns off when said operation button is unlocked by the cannonball being fired with the operation of said trigger lever.

40. A gun-shaped controller according to claim 27, wherein said game machine comprises image processing means for forming image signals capable of respectively displaying a cursor, which displays a moving direction of the main character, on a left and a right side of the screen of said display means; changing a color of said cursor in accordance with the signals for instructing directions and game development; and forming image signals capable of displaying the moving direction of the main character or outline of a situation of the main character during the game development using a combination of the colors thereof.

41. A gun-shaped controller according to claim 27, wherein said directional key is formed integrally with said gun-shaped controller and transmits said signals to move, at the least, said main character in a plurality of directions on said screen.

42. A gun-shaped controller according to claim 41, wherein said directional key of said gun-shaped controller is manually operable by the player, and said signals for instructing directions are signals for moving, at the least, said main character in a plurality of directions on said screen.

43. A fun-shaped controller according to claim 42, wherein said plurality of directions comprise movement of upward, downward, leftward, and rightward.

44. A gun-shaped controller according to claim 3, wherein said signals are supplied to said amusement device for instructing movement directions and controlling a movement of displayed objects such as characters appearing in a virtual game space in conformity with the instructed movement direction.

* * * * *